US006189286B1

(12) United States Patent
Seible et al.

(10) Patent No.: US 6,189,286 B1
(45) **Date of Patent: *Feb. 20, 2001**

(54) MODULAR FIBER-REINFORCED COMPOSITE STRUCTURAL MEMBER

(75) Inventors: Frieder Seible, Encinitas; Gilbert A. Hegemier, La Jolla, both of CA (US)

(73) Assignee: The Regents of the University of California at San Diego, San Diego, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/597,010

(22) Filed: Feb. 5, 1996

(51) Int. Cl.[7] ..... E04C 3/36; E04C 3/34

(52) U.S. Cl. ..... 52/721.4; 52/723.1; 52/737.4; 52/DIG. 7

(58) Field of Search ..... 52/DIG. 7, 721.1, 52/721.2, 721.4, 721.5, 723.1, 730.2, 737.1, 223.1, 649.2; 156/71

(56) References Cited

U.S. PATENT DOCUMENTS

| | | | | |
|---|---|---|---|---|
| 1,410,453 | | 3/1922 | Butcher . | |
| 1,858,512 | | 5/1932 | Langenberg et al. . | |
| 1,924,346 | | 8/1933 | Blumenthal . | |
| 2,480,180 | | 8/1949 | Bolton . | |
| 3,110,982 | * | 11/1963 | Besinger | 52/649.2 X |
| 3,421,271 | * | 1/1969 | Whitfield | 52/721.4 X |
| 3,524,231 | | 8/1970 | Wiswell . | |
| 3,890,794 | | 6/1975 | Broadfoot . | |
| 3,890,795 | | 6/1975 | Maurer . | |
| 4,023,734 | | 5/1977 | Colbert et al. . | |
| 4,071,996 | | 2/1978 | Muto et al. . | |
| 4,439,070 | | 3/1984 | Dimmick . | |
| 4,543,764 | | 10/1985 | Kozilkowski . | |
| 4,576,849 | | 3/1986 | Gardiner . | |
| 4,648,224 | * | 3/1987 | Kitta et al. | 52/DIG. 7 X |
| 4,722,156 | | 2/1988 | Sato . | |
| 4,783,940 | | 11/1988 | Sato et al. . | |

(List continued on next page.)

FOREIGN PATENT DOCUMENTS

| | | | | |
|---|---|---|---|---|
| 7041 | * | of 1895 | (GB) | 52/721.4 |
| 3-69715 | | 7/1989 | (JP) . | |
| 6220955 | * | 8/1994 | (JP) | 52/730.2 |
| WO 84/01402 | | 4/1984 | (WO) . | |

OTHER PUBLICATIONS

*Journal of Structural Engineering*, vol. 120, No. 3, Mar. 1994; Seismic Response of Full–Scale Five–Story Reinforced–Masonry Building, F. Seible, M.J.N. Priestley, G.R. Kingsley, and A.G. Kurkchubasche.

Mander, et al., "Theoretical Stress–Strain Model for Confined Concrete," *Journal of Structural Engineering, ACSE,* vol. 114, No. 8, Aug. 1988, pp. 1804–1826.

(List continued on next page.)

*Primary Examiner*—Carl D. Friedman
*Assistant Examiner*—Kevin D. Wilkens
(74) *Attorney, Agent, or Firm*—Knobbe, Martens, Olson & Bear, LLP

(57) ABSTRACT

A concrete-filled fiber-reinforced structural member comprising a concrete core encased in a lightweight fiber-reinforced composite shell formed by winding polymer impregnated high-strength filaments. The fibers are arranged for optimal strength and may be tailored for a specific requirement. The shell structure is durable, chemically inert, and adaptable to a variety of civil engineering applications. A plurality of composite structural members can be connected via connectors to form complex space frame structures such as industrial support structures, bridges, buildings and the like.

33 Claims, 19 Drawing Sheets

U.S. PATENT DOCUMENTS

| | | | | |
|---|---|---|---|---|
| 4,786,341 | * | 11/1988 | Kobatake et al. | 52/721.4 X |
| 4,795,666 | * | 1/1989 | Okada et al. | 52/DIG. 7 X |
| 4,830,540 | | 5/1989 | Abrams . | |
| 4,864,797 | | 9/1989 | Sato et al. . | |
| 4,941,775 | | 7/1990 | Benedict . | |
| 5,012,622 | | 5/1991 | Sato et al. . | |
| 5,043,033 | | 8/1991 | Fyfe . | |
| 5,049,005 | | 9/1991 | Lazare et al. . | |
| 5,097,646 | | 3/1992 | Lamle . | |
| 5,175,973 | | 1/1993 | Owen et al. . | |
| 5,193,939 | | 3/1993 | Nagatani et al. . | |
| 5,218,810 | | 6/1993 | Isley . | |
| 5,233,737 | | 8/1993 | Policelli . | |
| 5,242,721 | * | 9/1993 | Oonuki et al. | 428/34.5 |
| 5,305,572 | | 4/1994 | Yee . | |
| 5,435,667 | | 7/1995 | Strange . | |
| 5,447,593 | * | 9/1995 | Tanaka et al. | 52/DIG. 7 X |
| 5,460,463 | | 10/1995 | Smith . | |
| 5,555,696 | * | 9/1996 | Morrison, III et al. | 52/721.4 X |
| 5,599,599 | * | 2/1997 | Mirmiran et al. | 52/DIG. 7 X |
| 5,633,057 | * | 5/1997 | Fawley | 52/DIG. 7 X |
| 5,680,739 | * | 10/1997 | Cercone et al. | 52/741.3 |
| 5,694,734 | * | 12/1997 | Cercone et al. | 52/741.3 X |

OTHER PUBLICATIONS

Priestly, et al., "Seismic Shear Strength of Reinforced Concrete Columns," *Journal of Structural Engineering ASCE,* vol. 120, No. 8, Aug. 1994, pp. 2310–2329.

Priestly, et al., "Design Guidelines for Assessment of Retrofit and Repair of Bridges for Seismic Performance," *Structural Systems Research Report SSRP–92/01*, Department of Applied Mechanics and Engineering Sciences, University of California, San Diego, La Jolla, CA 92093, Aug. 1992.

National Seismic Conference on Bridges and Highways "Progress in Research and Practice" Dec. 10–13, 1995: "Advanced Composite Carbon Shell Systems for Bridge Columns Under Seismic Loads" by F. Seible, R. Burgueno, M.G. Abdallah and R. Nuismer.

"Fiber Composite in Infrastructure" Jan. 1996; Proceedings of the First International Conference on Composites in Infrastructure.

* cited by examiner 100
103
105
151
153
D
t

εc
εju
D
t fc
Fc
cx
fju
n
P
Fj n
Fj
P
Fc
NETURAL AXIS

MODULAR FIBER-REINFORCED COMPOSITE STRUCTURAL MEMBER

FEDERALLY SPONSORED RESEARCH & DEVELOPMENT

This invention was made with Government support under Agreement No. MDA 972-94-3-0030, awarded by ARPA, and Grant J61 93X00015, awarded by the U.S. Department of Transportation. The Government has certain rights in this invention.

BACKGROUND OF THE INVENTION

1. Field of the Invention

This invention relates to structural concrete members and, more particularly, to a low-cost concrete-filled reinforced-fiber composite structural member having improved strength and corrosion resistance, and to various methods for interconnecting a plurality of modular fiber-reinforced composite structural members to form framing and support structures having reduced construction and maintenance costs and resistance to seismic shock and chemical attack.

2. Description of the Related Art

Structural concrete members have found wide acceptance in a variety of civil engineering applications. The high compression strength of concrete, its low-cost and ready availability make it particularly suited for many civil applications such bridge columns, beams and support pylons. Concrete members may be prefabricated and assembled on-site using mechanical fasteners or, more typically, they may be cast in place on site using suitable form work.

For applications requiring high-strength and/or increased deformation capacity such as bridge support columns, reinforced concrete members are often used. Conventional reinforcement consists of embedded steel reinforcement bars or tensioning cables/rods running along the length of the structural member generally aligned with the member axis. Mild steel reinforcements are typically selected for use in seismic regions to maximize their inelastic deformation capacities and the ductile response characteristics of the reinforced concrete structural member in the event of seismic motion.

Pre-fabrication of such reinforced structural concrete members is possible, but due to their weight they are difficult and expensive to ship over any substantial distance. Also, heavy lifting equipment must be available on-site to position and support the structural members during assembly. On-site fabrication is also possible, but it is time-consuming and adds to the construction labor costs due to the necessity of: (1) creating a suitable temporary on-site form work to cast the concrete in the desired geometry; (2) tying the steel reinforcement, or cages (which sometimes must be welded) inside the concrete to provide adequate tensile capacity; and (3) removing and disposing of the form work once the concrete cures.

Even after the initial construction is completed, there are often significant additional costs needed to repair and/or maintain conventional steel reinforced concrete structures, particularly in areas prone to seismic activities or areas exposed to salt or other chemical agents. This is because conventional reinforced concrete, based on its design philosophy, needs to crack to transfer flexural tension forces to the steel reinforcement. These cracks form on the tension side of the concrete member as the steel reinforcement bars stretch in response to the applied load. These cracks allow water and air to enter and corrode the steel reinforcement. This corrosion of steel is accompanied by a volumetric expansion of the steel cross-section.

Over time, local corrosion of steel reinforcements around the crack area can flake-off the concrete cover and weaken the structural integrity of the concrete member, causing it to fall below required minimal standards and design capacities. Labor-intensive repair work is often required to restore the structural integrity of the member and corrosion of the steel reinforcement will typically continue even after such repairs.

Pre-stressing the reinforcement bars or providing internal support such as post-tensioning cables/rods can increase the nominal elastic strength of the reinforced concrete structural member, thereby limiting the amount of stress-induced cracking. See U.S. Pat. No. 5,305,572 to Yee. But this produces a stiffer structural member that is less able to deform and absorb energy and, therefore, more prone to brittle failure. Generally, it is desirable to retain as much ductile deformation capacity as possible, particularly in seismic areas.

U.S. Pat. No. 4,722,156 to Sato suggests the use of a pre-fabricated outer steel tube or jacket to provide a form work for concrete structural members which can be left in place as reinforcement once the concrete cures. Because the steel reinforcement tube is outside the concrete core, corrosion or other weakening of the steel reinforcement can be visually inspected and repaired.

A drawback of steel tubes, however, is that they are heavy and difficult to work with. Heavy lifting equipment is required on site to position and support the steel tubes during assembly. The added weight of steel reinforcements undesirably increases the seismic excitation mass of the structure. Skilled welders are also required to weld adjacent tube members. Such welding is undesirable because it not only adds to the overall cost of construction, but also because the welded joints are subject to brittle failure. Moreover, the resulting structure is still susceptible to corrosion damage, particularly in corrosive chemical or marine environments, since the steel reinforcement member is fully exposed. This increases the maintenance costs due to the need to periodically paint the steel tube and repair any corrosion damage.

Others have proposed replacing conventional steel reinforcement bars or tensioning rods with non-corroding composite materials such as carbon, aramid, or glass fibers maintained in a hardened polymer matrix. Such materials have shown great promise in the seismic retrofitting of existing reinforced concrete structural members such as walls, bridge columns and support pylons. See Seible, F., Priestley, M. J. N., Kingsley, G. R. and Kurkchubasche, A., "Seismic Response of Five Story Full Scale Reinforced Masonry Building," *ASCE Journal Of Structural Engineering*, March 1994, Vol. 120, No. 3, pp. 925–946, incorporated herein by reference. Carbon fibers are applied to the outer periphery of an earthquake-damaged concrete structural member by winding the fiber strands around the periphery of the concrete structural member while impregnating the fiber material with a suitable resin. This increases the strength of the reinforced concrete member by helping confine the concrete to prevent brittle failure. See U.S. Pat. No. 5,043,033 to Fyfe and U.S. Pat. No. 4,786,341 to Kobatake et al.

However, such composite materials have had only limited success in new construction in terms of structural effectiveness and economy. Unresolved technical difficulties such as anchorage problems and long term creep/relaxation have discouraged replacement of steel reinforcement bars with carbon fiber rods or tendons. Increased material costs several times that of conventional steel reinforced concrete members, have discouraged further research and development in this area.

On the other hand, the continuing practice of retro-fitting existing concrete structures is difficult and time-consuming. Also, the carbon fibers are generally oriented at angles nearly perpendicular to the longitudinal axis of the structural member in order to maximize the confinement strength. Thus, the fibers do not significantly contribute directly to the bending deformation capacity of the retrofitted structural member. Rather, steel reinforcement is still required. Finally, such retrofitting techniques have not addressed the issue of the connections between adjacent structural members. This is a critical consideration since the integrity of any structure composed of multiple structural members is limited by the strength and toughness of the connections which hold the individual structural members together.

SUMMARY OF THE INVENTION

There is currently a need in the industry for a low-cost, light weight reinforced structural member that is not subject to corrosion effects and which can be quickly and easily assembled on site using light-duty equipment and unskilled or semi-skilled labor and which can be pre-fabricated in the form modular components and shipped on-site virtually anywhere in the world. It is therefore an object of the present invention to fulfill this need and overcome the aforenoted drawbacks and limitations of conventional reinforced concrete structural members.

In accordance with one embodiment the present invention provides a pre-manufactured, lightweight, fiber-reinforced shell which can be quickly and easily assembled on site and filled with concrete to form a composite structural member having compression strength characteristics of concrete and tensile strength characteristics of the composite fibers. Despite the relatively high material costs of high-strength fiber materials (e.g., carbon=approximately $10–$15 per pound), the overall life-cycle cost of a fiber-reinforced composite system constructed in accordance with the present invention can be surprisingly less than that of a conventional reinforced concrete structural system having comparable load/deformation capacity. This is primarily due to significant cost savings in the ability to use unskilled or low-skilled labor to assemble the lightweight shells, the lack of labor intensive form work and form work removal steps and placement and tying of reinforcement, faster construction schedules, increased durability and reduced maintenance costs.

In accordance with another embodiment the present invention provides a fiber-reinforced shell comprising filaments of high-strength fibers wound at one or more predetermined angles to one or more predetermined thicknesses, each angle and/or thickness being selected to provide optimal strength and confinement for design flexure, as well as shear for a given overall wall thickness. In one preferred embodiment, the outer shell is formed from a first group of reinforcing fibers oriented at a first angle relative to a longitudinal axis of the shell and having a combined first predetermined thickness and a second group of fibers oriented at a second angle relative to the longitudinal axis of the shell and having a combined second predetermined thickness. The first predetermined thickness is between about 0.1 to 0.5 inches, and the second predetermined thickness is between about 0.005 to 0.1 inches. The shells are lightweight and, therefore, easy to handle on site. The shells are further formed so as to have substantial tensile strength capacity in the longitudinal direction such that additional reinforcements are not required, although they may optionally be used.

In accordance with another embodiment the present invention provides a method and device for elastic splice connection of adjacent composite structural members. A coupler is provided which can be mated to the ends of adjacent fiber-reinforced composite members and fixed in place via a suitable adhesive or mechanical fasteners. Once the coupler is in place the resulting structure is then filled with concrete to form the composite structural member. The coupler thus provides a fully elastic connection between adjacent structural members.

In accordance with another embodiment the present invention provides a plastic hinge connection for connecting adjacent composite structural members. Steel reinforcement bars are placed around the internal periphery of the adjacent shell members and encased in concrete. Annular spacers are used to maintain the reinforcement bars in place while concrete is pumped into the shells.

In accordance with another embodiment the present invention provides a method and device for securing a composite structural member to a concrete footing. A plurality of steel reinforcements are secured in footing in a generally circumferentially spaced orientation. The fiber-reinforced shell is then placed over the steel starter bars and filled with concrete which is allowed to cure to secure the structures together. In an alternative embodiment, the outer shell may be extended directly into the footing and cast in place by pouring concrete into both the footing and into the outer shell.

In accordance with another embodiment the present invention provides a fiber-reinforced shell having ribs or similar features to prevent movement of the concrete core relative to the shell and to provide a force transfer mechanism between the concrete core and the shell. The ribs may be placed at the ends only of the shell to maintain suitable connection with an adjacent structural member or they may be provided continuously throughout the interior of the shell in order to provide adequate bonding with the concrete core over the length of the composite member.

In accordance with another embodiment the present invention provides a truss bridge formed of a plurality of composite structural members. The truss members are assembled on site using modular fiber-reinforced shells and then filled with concrete to form the resulting structure. Alternatively, the present invention provides an arch bridge or cable stayed bridges formed of composite structural members.

In accordance with another embodiment the present invention provides a fiber-reinforced shell of a predetermined thickness determined in accordance with a particular disclosed design criteria to provide optimal strength, toughness and cost effectiveness.

These and other objects and advantages of the present invention will become readily apparent to those skilled in the art in view of the following description of the preferred embodiments, taken together with the referenced figures, the invention not being limited, however, by the particular preferred embodiments disclosed.

DETAILED DESCRIPTION OF THE PREFERRED EMBODIMENT

Figure 1A:
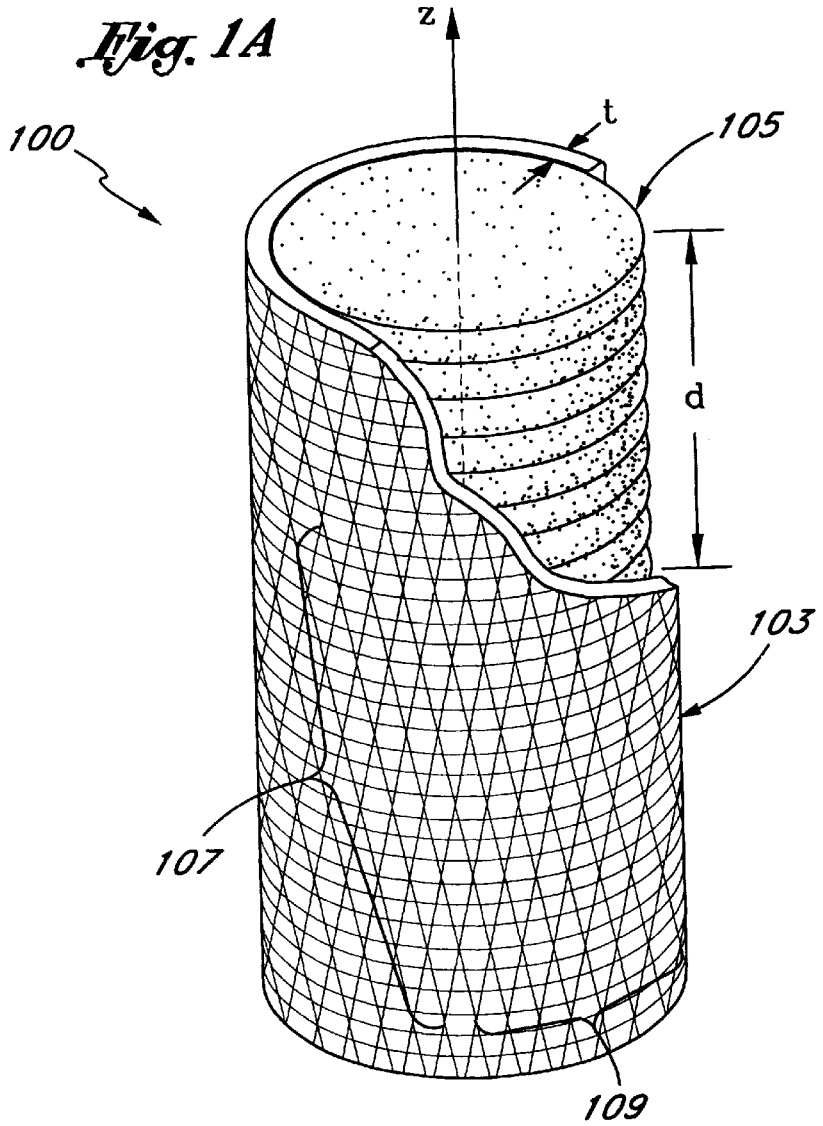
FIG. 1A is a perspective, partial cut-away view of a fiber-reinforced composite structural member having features of the present invention.
Figure 1B:
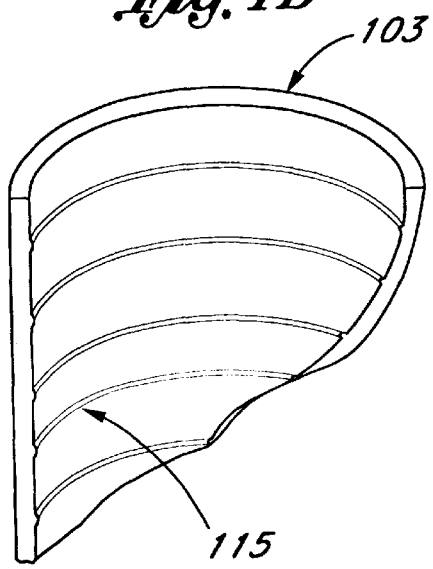
FIG. 1B is a perspective, partial cut-away view of a fiber-reinforced shell having features of the present invention.
Figure 2A:
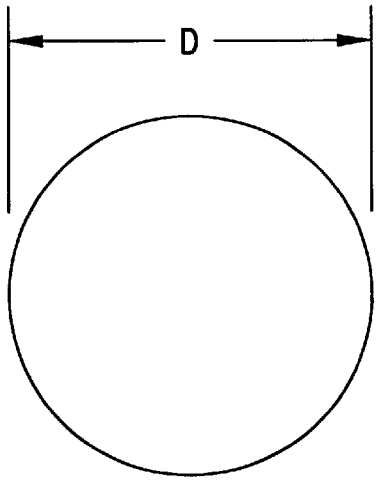
FIGS. 2A–2C are schematic representational views illustrating several possible cross-section shapes of a fiber-reinforced shell having features of the present invention.
Figure 2B:
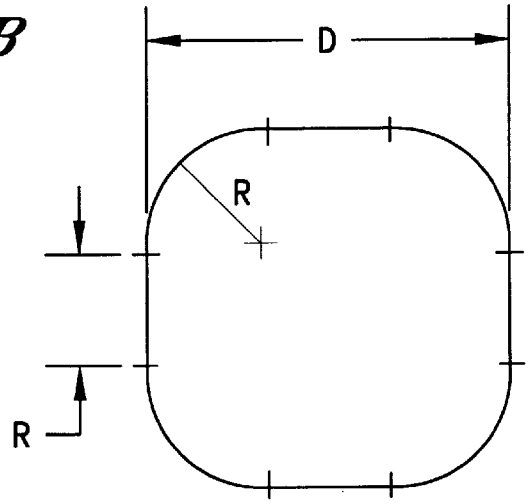
Figure 2C:
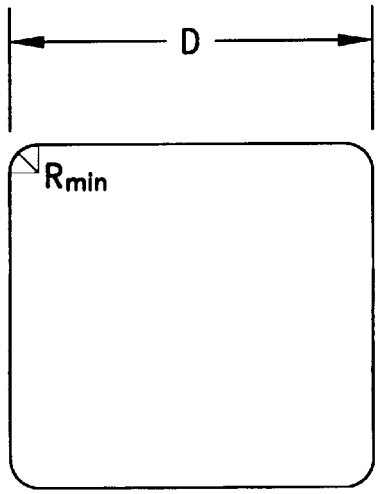

FIGS. 1A and 1B illustrate a partial cut-away view of a fiber-reinforced composite structural member 100 having features of the present invention. The particular composite member shown has a cylindrical shape, which is preferred because it offers the most efficient use of materials for a given cross-section and provides maximum structural integrity. The invention is not limited to cylindrical structural members, however, but may be practiced using a wide variety of other shapes and sizes such as illustrated in FIGS. 2A–2C, which are provided by way of example only. FIG. 2A illustrates the preferred circular cross-section described above. FIG. 2B illustrates a confined rectangular or "conrec" cross-section, which may have certain advantages in applications requiring a relatively flat beam or column surface. FIG. 2C illustrates a substantially square cross-section having a relatively small external corner radius, $R_{min}$, as shown. These and other convex tubular, prismatic, or nonprismatic shapes may be used while enjoying the benefits and advantages of the present invention disclosed herein.

As discussed in more detail below and referring again to FIG. 1, the composite member 100 generally comprises a fiber-reinforced outer shell or jacket 103 and a concrete core 105 which is poured into and cured in place within the shell 103.

Fiber-Reinforced Shell

The shell 103 is composed of multiple windings 107, 109 of high-strength fiber filaments maintained in operative relationship within a suitable polymer matrix or binder. Suitable high-strength fibers may include, for example and without limitation, glass or aramid fibers or, more preferably, high-strength carbon fibers. Suitable, polymer matrix materials may include, without limitation, any one of a variety of epoxies, vinyl esters, or polyesters which can be hardened by chemical, heat or UV curing. Epoxy resin, and more specifically Hercules Aerospace HBRF-55A epoxy resin, is particularly preferred as a matrix material because of its excellent mechanical properties and availability. Various well-know additives may be added to the uncured polymer matrix, as desired, to enhance workability, mechanical performance and/or to retard flammability or provide protection from UV radiation.

The filaments are preferably applied in a conventional manner by winding tows of high-strength filaments around a rotating mandrel. The tows can either be pre-coated with a polymer binder in the form of a preimpregnated material ("dry winding") or they may be saturated in a resin bath just prior to winding onto the mandrel (wet winding), as desired. The filament windings are layered one over another to form a shell having a predetermined wall thickness "t".

The various filament layers are preferably wound onto the mandrel at one or more predetermined winding angles in order to tailor the stress and bending characteristics of the shell 103 in accordance with predetermined design criteria. In the preferred embodiment shown, carbon fiber filaments 107, 109 are wound at angles of ±10° (longitudinal fibers) and 90° (hoop fibers), respectively, relative to the longitudinal "z" axis of the composite member 100. Of course, other winding angles may be used while still enjoying the benefits and advantages of the present invention as taught herein.

The layers of wound filaments may be criss-crossed in a weave or other pattern, as desired, or they may be separated into discrete layers, depending upon design considerations and material costs. For instance, the filament layers may be applied to form discrete portions such that, for instance, the inner portion of the shell 103 is composed of substantially all 90° fibers 109 while the outer portion of the shell 103 is composed of substantially all ±10° fibers 107. Conversely, layers of filaments at one winding angle may be interlineated between multiple layers of filaments wound at a different winding angle.

The above description of preferred fabrication techniques is for illustrative purposes only. Those skilled in the art will readily appreciate that a wide variety of other fabrication techniques may be used to produce a shell 103 having desired strength and compliance characteristics in accordance with the present invention. Other suitable fabrication techniques may include, for example, application of high-strength fiber cloth to a form or rotating mandrel, application of randomly oriented "chopped" fibers to a form or mandrel, continuous extrusion of chopped fiber in a matrix material, or continuous weaving and polymer coating of a tubular sleeve composed of high-strength fiber filaments.

The inner surface of the shell 103 preferably has ribs 115 formed on at least a portion thereof as shown in the partial cut-away view of FIG. 1B. The ribs 115 provide a mechanical bond interlock between the outer shell 103 and the inner concrete core 105. The ribs 115 preferably have a height of about 0.01 to 0.10 inches, and more preferably about 0.045 inches, and are formed to approximate the knurled outer surface of a conventional steel reinforcement member. Of course, other convenient shapes and sizes may also be used, as desired.

The ribs 115 may be concentric or helical continuing from one end of the fiber-reinforced composite shell to a desired depth d, as shown in FIG. 1A. Alternatively, the ribs 115 may extend continuously over the length of the fiber-reinforced composite shell 103 in order to provide a mechanical bond between the shell 103 and concrete core 105 over the entire length of the member 100. Preferably, the ribs 115 are formed as raised protrusions which extend from the inner surface of the shell 103 into the concrete core 105 such that the ribs 115 do not decrease the thickness of the shell 103 at the point of attachment. Alternatively, the thickness of the shell 103 adjacent each rib 115 may be increased to compensate for any variations in the wall thickness "t" caused by the ribs 115.

Concrete Core

The concrete core 105 may comprise a conventional mortar or concrete grout having sand or aggregate added, as desired. Alternatively, the concrete core 105 may be composed entirely or partially of any one of a number of specialty cements, aggregates or grouts such as lightweight concrete, foamed concrete or other curable masonry solids as are well-known and readily available in the construction industry.

Various additives may be mixed in with the uncured concrete core 105 to improve its workability and/or to provide enhanced structural properties. Other well-known additives may be added to prevent excessive shrinkage of the concrete core 105 during curing or to dilate the concrete core 105 during curing so that the shell 103 maintains adequate minimal confinement pressure against the cured concrete core 105. Based on parametric studies, a dilation strain of about $\epsilon_d$=0.001 inches was found to produce adequate confinement pressure in the plastic hinge or "transition" region.

The concrete core 105 is initially poured into the fiber-reinforced composite shell 103 in its liquid or uncured state. The shell 103 provides a form work for retaining the liquid concrete as it cures. Mechanical agitators or other vibrators may be used, as desired, to settle the concrete within the shell 103 to discourage the formation of voids. The use of concrete thinners, sand or finely graded aggregate may also assist in producing a homogenous, void-free concrete core 105. Optional steel reinforcement members or post-tensioning cables/rods (not shown) may be provided in the concrete core 105 for added strength, although they are not required to practice the invention herein disclosed.

Composite Column/Pylon Design

While it is envisioned that the present invention may be applicable to a wide range of civil engineering and structural design applications, early developments have focused on the design of fiber-reinforced composite column supports and pylons. Therefore, while the following detailed description relates specifically to the design of various composite column support members and pylons it should be kept in mind that the principles and design techniques disclosed herein are equally applicable to the design of other composite structural members such as beams, joists, trusses, arches, etc.

Figure 3B:
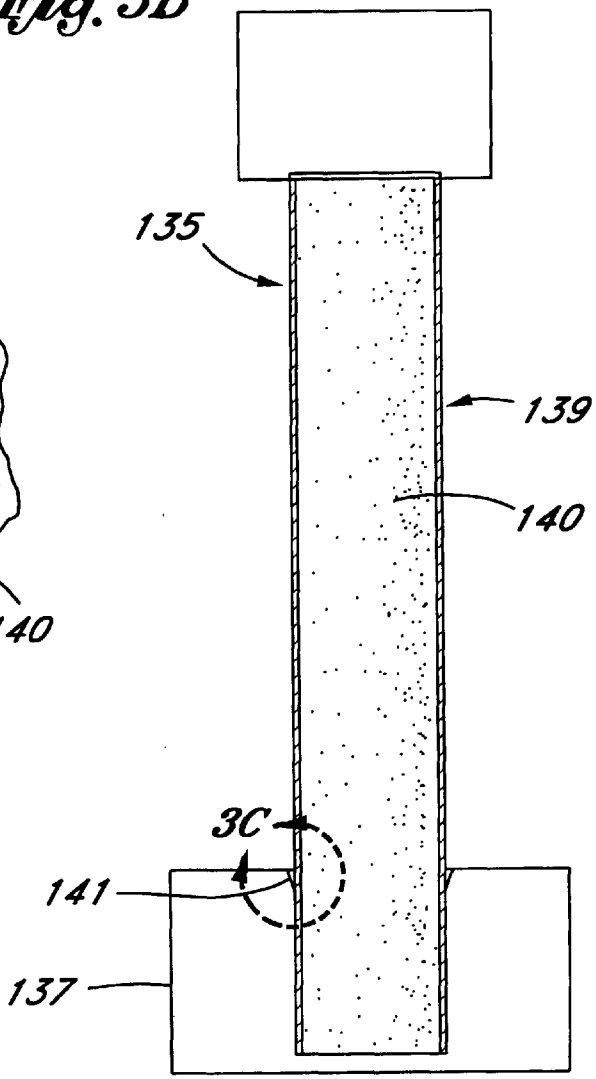
FIG. 3B is a longitudinal cross-section view of a fiber-reinforced composite structural member having features of the present invention, illustrating an alternative preferred method of securing the composite member to a footing.
Figure 3C:
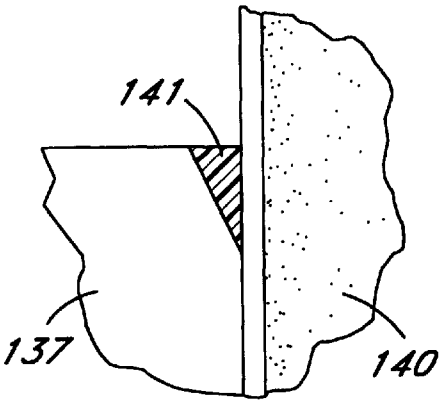
FIG. 3C is an enlarged cross-section view of the fiber-reinforced composite structural member of FIG. 3B at the footing interface.
Figure 3A:
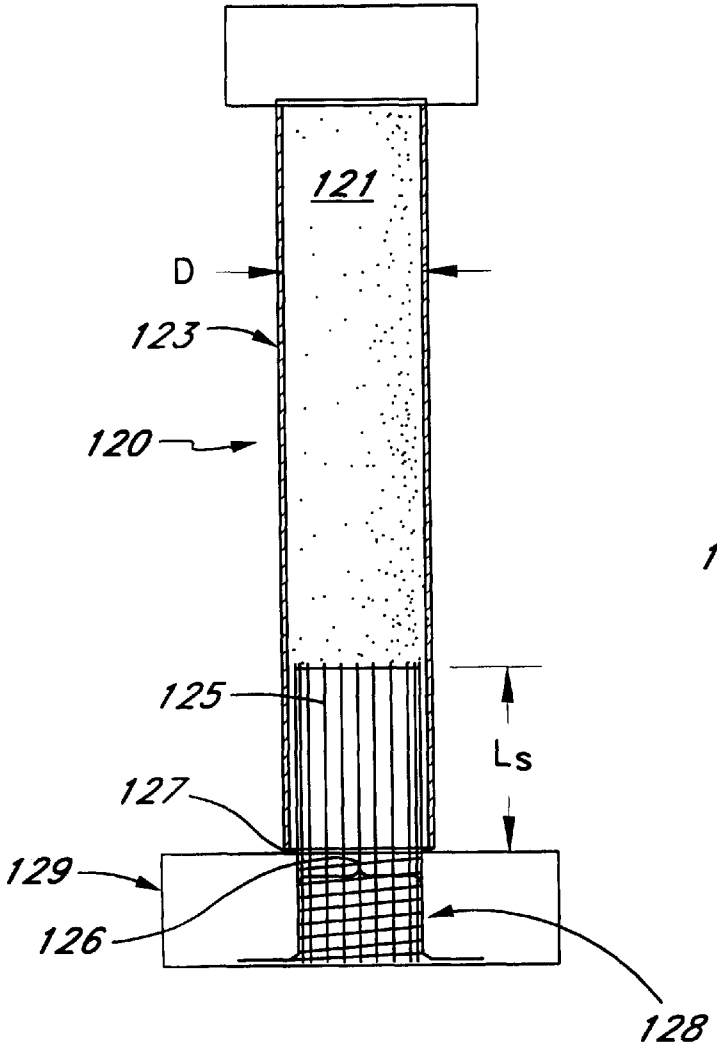
FIG. 3A is a longitudinal cross-section view of a fiber-reinforced composite structural member having features of the present invention, illustrating one preferred method of securing the composite member to a footing.

FIGS. 3A and 3B show two alternative embodiments of a fiber-reinforced composite column member having features of the present invention. The composite column of FIG. 3A is designed for maximum ductility response and deformation capacity and is preferred for use in areas prone to seismic activity. The composite column of FIG. 3B is designed for maximum strength and is preferred for use in either non-seismic areas or in seismic areas having medium ground excitations.

Beginning with the embodiment shown in FIG. 3A, the composite member 120 comprises a fiber-reinforced outer shell 123 of internal diameter "D" and an inner concrete core 121 of substantially equal outer diameter, as shown. The composite column 120 is mounted to a footing 129 via a plurality of soft steel "starter" bars 125. Those skilled in the art will appreciate that the starter bars 125 and the confinement provided by the shell form a plastic hinge which maximizes the ductile compliance of the column 120 in the event of seismic shock.

The column 120 is secured to the footing 129 by creating a form work for the footing and positioning the starter bars 125 therein. The bars 125 are preferably L-shaped or T-shaped and are arranged in a spaced circular pattern with the lower end of each bar extending radially outward and/or inward, as shown. The upper vertical portions of the starter bars extend upward into the shell 123 a predetermined distance "$L_s$" and define an imaginary cylinder having a diameter between about 1 to 5 inches, and more preferably about 3 inches, smaller than the inner diameter "D" of the shell 123. If desired, the lower vertical portions of the starter bars may be tied together by wrapping one or more reinforcement members 126 continuously around the starter bar members 125 using conventional construction methods to form a reinforcement cage 128.

After the starter bars 125 are secured in place, the footing 129 is poured and the concrete is allowed to cure. The shell 123 is then placed over the starter bars 125 and secured in place using braces, scaffolding or other suitable support structure. A small gap 127 is preferably provided between the base of the shell 123 and the upper surface of the footing 129 in order to prevent crushing of the shell 123 in the event of large angular displacement of the composite column 120. A gap 127 of between about 0.5 and 3.0 inches, and more preferably about 1.0 inches, should be sufficient for most applications. If desired, a compliant material such as rubber, foam or a metal ring (not shown) may be positioned in the gap 127 to seal the shell 123 to the top surface of the footing 129 to prevent leakage of the concrete core 121 while it is in its uncured state.

Once the shell 123 is secured (and optionally sealed) to the footing 129, concrete is then poured into the shell 123 to a desired level. If a secondary connection is required at the top of the column 120, this may either be placed in position before pouring the concrete core 121 or connection may be accomplished in phases. For example, concrete may be poured to a first level, allowed to set while additional joints and connections are secured in place, and then poured to a second level, repeating the process as many times as needed to form the support frame structure.

As briefly noted above, a mechanical agitator or vibrator may be used during pouring of the concrete core 121 in order to consolidate the concrete mixture and inhibit formation of voids. Alternatively, the concrete may be pressure pumped into the shell 123 and sealed under pressure with substantially the same desired result. Nonshrinking or expansive concrete may also be used, as noted above, to ensure that adequate confinement pressure is maintained against the concrete core 121. If a large amount of shrinkage is contemplated, the size of the ribs 115 (FIG. 1B) may also be increased to maintain mechanical interlock between the shell 123 and the concrete core 121.

In the alternative embodiment shown in FIG. 3B the shell 139 extends directly into the footing 137, as shown, which is increased in depth to accommodate the higher expected stress. Once the shell 139 is secured in place, the concrete core 140 and the footing 137 are cast simultaneously. Optionally, a transition region 141 may be provided around the base of the column 135 at the footing interface, as shown in FIG. 3C, to provide a compliant transition between the composite column 135 and the footing 137. The size of the transition region 141 may be varied as desired, but is preferably in a range of 1–3 inches greater than the diameter of the composite column 135 at the largest point tapering down to zero within 5–12 inches from the top of the footing 137. Those skilled in the art will readily appreciate that a wide variety of other shapes and sizes may be used while enjoying the benefits and advantages taught herein. The transition region 141 preferably comprises a compliant material such as a structural adhesive having a lower modulus of elasticity than that of concrete, and more preferably, less than about one-half the modulus of concrete.

An optional outward extending lip or flange may also be formed on the lower end of the shell 139 in order to provide added resistance to axial pull-out of the shell. Holes may also be provided in the composite member 135 to accommodate horizontal anchoring bars, as desired. Alternatively, those skilled in the art will readily appreciate that many other suitable methods and connection devices may be used to secure a composite member to a footing or other structure while enjoying the benefits and advantages of the present invention as taught herein.

Design Methodology

An advantageous feature of a fiber-reinforced composite structural member constructed in accordance with the present invention is the ability to precisely tailor the strength and compliance characteristics of the composite member by selecting a suitable arrangement of fiber orientations and lamination sequences for forming the fiber-reinforced shell. In the simplest case the shell may be fabricated from high-strength filaments applied uniformly along the length of the shell. Alternatively, the orientation and/or thickness of the filament layers may be varied along the length of the shell, as desired, to provide strength and compliance only in those areas where it is needed. The ability to tailor the strength characteristics of the fiber-reinforced shell is an important advantage of the present invention because it allows more efficient use of raw materials that are otherwise more expensive than conventional materials such as steel.

The efficient design of composite structural members in accordance with the present invention may be successfully guided by a capacity design approach taking into consideration three critical actions—flexure, shear and confinement. Each is considered below:

Design for Flexure

Flexure capacity of a composite member constructed in accordance with the present invention is based on an evaluation of the shell wall thickness required to maintain force and moment equilibrium at a given cross-section for a given loading. The force equilibrium condition is illustrated graphically in FIGS. 4A–4D.

Figures 4A, 4B, 4C, 4D:
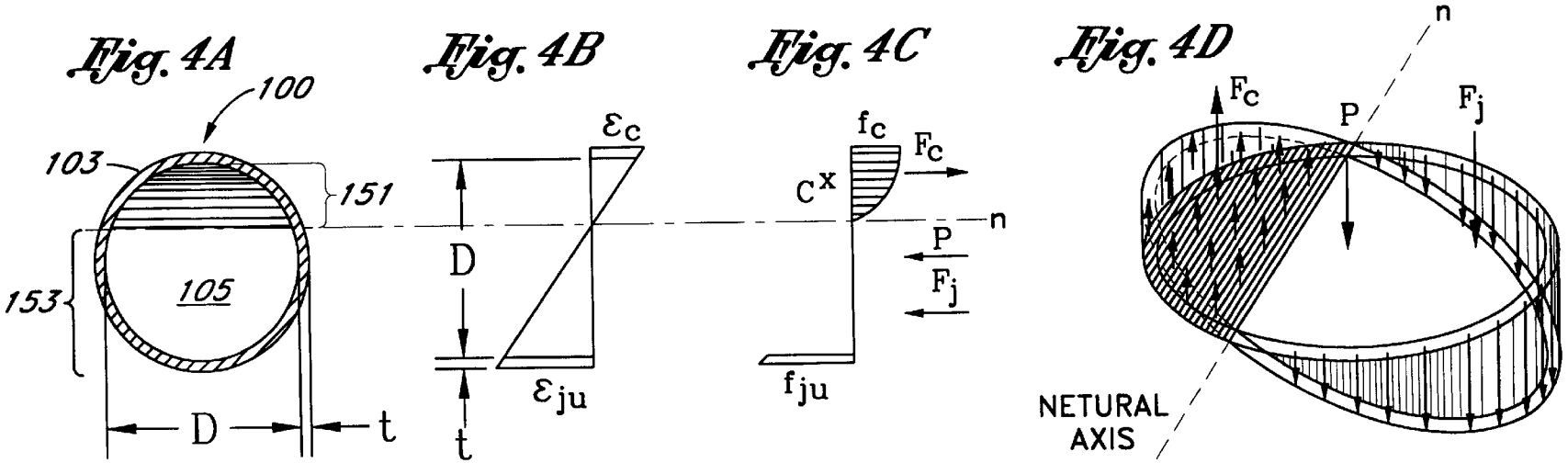
FIGS. 4A–4D are stress-strain diagrams illustrating typical compressive and tensile forces in a fiber-reinforced composite structural member having features of the present invention.

As illustrated in FIG. 4A, subjecting the composite member 100 under a design load P to a given nominal design capacity moment $M_n$ creates a compression force $F_c$ in the concrete core distributed over the area 151. This compression force is counteracted by a tension force $F_j$ in the portion 153 of the shell 103 on the opposite side of the neutral axis "n", as shown in FIGS. 4C and 4D.

For a given cross-section of a composite member the equilibrium condition may be stated mathematically as follows:

$$F_j+P=F_c$$

$$M_j+M_c+M_p=M_n \quad (1)$$

where: P=the nominal axial load;

$F_j$=the maximum tensile force component of the fiber-reinforced composite shell, taking into account fiber orientations;

$F_c$=the maximum compression force component of the concrete core;

$M_j$=the maximum moment component supplied by the fiber-reinforced composite shell;

$M_c$=the maximum moment component supplied by the concrete core;

$M_p$=the resultant moment component supplied by the axial load P; and $M_n$=the nominal design moment capacity of the concrete filled composite member.

In the above equations, $F_j$, $M_j$ and $F_c$, $M_c$ are determined by integrating the stresses in the outer shell around the circular geometry and integrating the compressive stresses on the concrete core over the compression portion of the cross-section. Stresses are evaluated based on a linear strain profile as defined by the ultimate load condition. Stresses in the fiber-reinforced composite shell are calculated based on the equivalent elastic modulus corresponding to each selected fiber orientation. In this case, longitudinal fibers having a winding angle $\theta \approx 0°$ (practical lower end$\approx$+10° due to manufacturing considerations) provide maximum strength in flexure. The compressive stresses in the concrete core are calculated based on the confined concrete stress-strain model proposed by Mander, et al., "Theoretical Stress- Strain Model for Confined Concrete," *Journal of Structural Engineering, ASCE*, Vol. 114, No. 8, August 1998, pp. 1804–26, incorporated herein by reference.

Integrating the above equations and solving for the equilibrium condition, yields the derilation for the predicted minimum shell wall thickness for a given winding angle required to support a nominal design moment capacity $M_n$. Slip between the shell and the concrete core can also be considered in this model based on the size of the ribs provided in the shell inner surface.

Design for Shear

The shear force capacity of a composite member constructed in accordance with the present invention is determined based on the predictive shear strength model proposed by Priestley, et al., "Seismic Shear Strength of Reinforced Concrete Columns," *Journal of Structural Engineering, ASCE*, Vol. 120, No. 8, August 1994, pp. 2310–29, incorporated herein by reference. In this model, the shear strength of a composite structural member is considered to consist of three independent components: a concrete component $V_c$ whose magnitude depends on the ductility of the concrete, an axial load component $V_p$ whose magnitude depends on the aspect ratio of the structural member (length versus diameter), and a truss component $V_j$ whose magnitude depends, in this case, on the effective strength of the shell reinforcement. The equilibrium condition is stated as follows:

$$V_n=V_c+V_p+V_j \tag{2}$$

Figure 5:
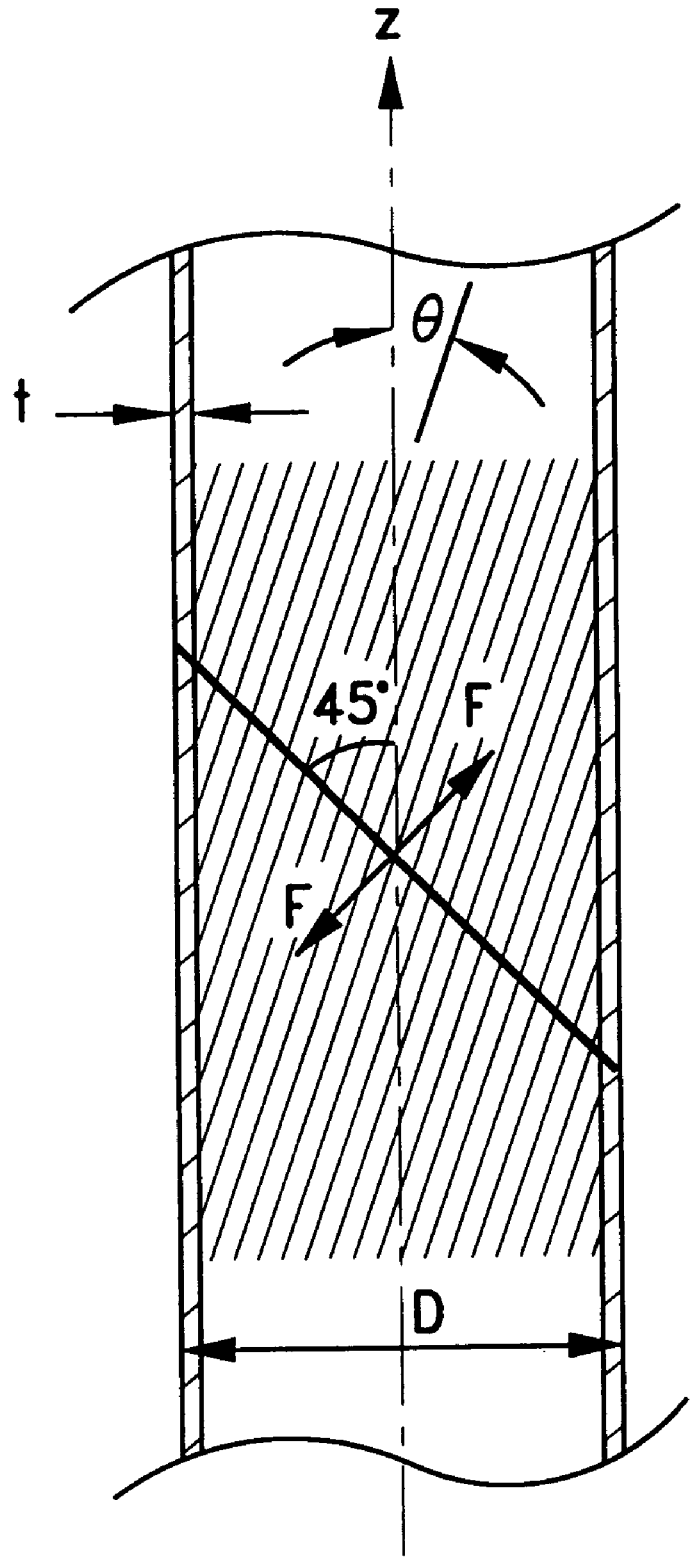
FIG. 5 is a schematic force diagram illustrating typical shear characteristics of a fiber-reinforced shell having features of the present invention along an assumed shear plane of 45 degrees.

The contribution $V_j$ of the outer shell to the overall shear strength of the composite member is based on an assumed 45° shear plane (i.e., crack pattern) relative to the axis "z", as illustrated in FIG. 5. For multiple fiber orientations at winding angles $\pm\theta_i$, the truss component $V_j$ can be expressed as follows:

$$V_j=\sum_{i-1}^{n}\frac{\pi}{2}Dt_i\phi[f_{45°-\theta_i}+f_{45°-\theta_i}] \tag{3}$$

where: n=number of winding angles;

D=diameter of the cross-section;

$t_i$=shell wall thickness for winding angle $\pm\theta_i$;

$\phi$=material strength reduction factor; and $f_\alpha$=ultimate tensile strength of the reinforced fiber at an orientation angle $\alpha$.

Again, longitudinal fibers having a winding angle $\theta\approx 0°$ (practical lower end≈±10°) provide e maximum strength in shear.

Design for Confinement

As with the flexure and shear design approaches discussed above, the confinement capacity o f a composite member constructed in accordance with the present invention is based on an evaluation of the shell wall thickness required to maintain equilibrium at maximum load condition. In this case, confinement requirements vary depending upon the design of the composite member and, in particular, whether it includes a plastic hinge r region where the member connects to a plastic hinge or starter bars. In the plastic hinge region, confinement or clamping capacity is based on a bond failure mechanism occurring around the outer perimeter of the starter bars 125 (FIG. 3A) under direct tension pull-out of the fiber-reinforced shell 123.

In this region, the design approach is based on accepted principles for confinement of conventional lap-splices. See Priestley, et al., "Design Guidelines for Assessment Retrofit and Repair of Bridges for Seismic Performance," Research Report SSRP-92/01, Department of Applied Mechanics and Engineering Sciences, University of California, San Diego, La Jolla, Calif. 92093, August 1992, incorporated herein by reference. Based on these principles and experimental studies, the nominal required dilation strain of a composite column member of diameter D in the end or plastic hinge region may be estimated as follows:

$$\epsilon_{cu}=0.004+2.5\rho f_{uj}\epsilon_{uj}/f'_{cc} \tag{4}$$

where: $\rho$=volume confinement ratio=4 t/D;

$f_{uj}$, $\epsilon_{uj}$=ultimate allowable dilation stress and strain, respectively, of the shell taking into account fiber orientation;

$f'_{cc}$=compressive strength of the concrete core based on Mander's stress-strain model for confined concrete:

$$f'_{cc}=f'_c\left[-1.254+2.254\sqrt{1+\frac{7.94\ f_l}{f'c}}-\frac{2f_l}{f'c}\right] \tag{5}$$

where: $f_l$=the desired confining pressure; and $f_c'$=nominal compressive strength of unconfined concrete.

Equilibrium of in-plane forces in a section perpendicular to the member axis results in the equation of the required estimated minimum jacket thickness $t_i$ as follows:

$$t_i=0.1(\epsilon_{cu}-0.004)Df'_{cc}/f_{uj}\epsilon_{uj} \tag{6}$$

Fibers orientated at a winding angle $\theta=90°$ ("hoop fibers") provide maximum confinement strength. One convenient design approach, therefore, is to first determine the number of layers of longitudinal fibers ($\theta\approx\pm 10°$) needed to provide required strength in flexure and in shear and then use the above equation to determine the number of additional layers of hoop fibers required to provide adequate confinement strength. Alternatively, the above equations may be solved simultaneously for the minimum and/or maximum uniform winding angle $\pm\theta_i$ required to provide the required flexure, shear and confinement capacity for a given shell cross-section.

Outside the plastic hinge region, the design objective is simply to provide sufficient confinement pressure to match the performance of conventional reinforced concrete members. Through parametric study it was determined that a confinement pressure $f_l$ of about 150 to 600 psi (1 to 4 MPa), and more preferably about 300 psi (2 MPa), at a dilation strain $\epsilon_d$ of about 0.001 to 0.008 inches, and more preferably about 0.004 inches, provides acceptable performance for most applications. Based on these preferred ranges, the minimum shell wall thickness "$t_i$" for winding angle $\pm\theta_i$ required in the midspan region of a composite member constructed in accordance with the present invention can be calculated as follows:

$$t\geqq 125Df_l/E_\theta=37.5D/E_\theta \tag{7}$$

where D=inner diameter of the shell;

$f_l$=the desired confining pressure; and $E_\theta$=the effective modulus of elasticity of the shell in dilation for winding angle $\pm\theta_i$.

Advantageously, those skilled in the art will appreciate that the above-described design procedures, equations and guidelines may be used in accordance with the teachings of present invention to determine efficient winding angles and shell thicknesses of multiple filament layers for providing desired shell strength and compliance characteristics.

EXAMPLES

The following examples illustrate several structures of fiber-reinforced composite structural members made in accordance with the present invention. These examples are provided for illustrative purposes only and are not to be construed as limiting in any way on the invention herein disclosed and described.

Example 1 ("CS1")

The first fiber-reinforced composite structural member ("CS1") was produced at Plant No. 2 filament winding facility at Hercules Aerospace Company in Salt Lake City, Utah using conventional filament winding methods employed in the manufacturing of pipes, vessels, casings and other structures so formed. The shell was formed by winding and automatic layering of multiple tows of reinforced-fiber filaments onto a rotating mandril in accordance with a predetermined winding pattern.

The mandril was of a conventional "breakdown" type formed from a steel frame to which segmented balsa wood was applied. A no tracers carbon cloth fabric AW370-5H was used to form the very inner surface of the shell to avoid surface damage to the structural plies upon interaction with the mandril. The shell was then wound with AS4D-GP (12K) carbon fibers impregnated in a Hercules HBRF-55A epoxy resin system. Tows of the high-strength filaments were wound onto the mandril under tension, providing uniform rows or layers of substantially pore-free fiber-composite material. Separating layers were applied as needed to achieve a substantially uniform consistency of the material. Winding and coating sequences were in accordance with conventional practices for the prescribed thicknesses to ensure adequate quality control of the laminated materials and to provide a uniform, relatively void-free structure.

Spiral ribs were formed on the internal portion of the shell in the plastic hinge regions by forming spiral grooves in the mandril. The rib amplitude was 0.045 inches (1.2 mm) square with a pitch of 0.5 inches (13 mm) and extending inward 40 inches (1 m) from each end of the shell.

The CS1 shell was assembled on-site (UCSD test-site) and filled with concrete as shown and described above in connection with FIG. 3A. Table 1, below, summarizes various parameters of the fiber-reinforced composite structural member constructed in accordance with Example 1 and as illustrated in FIG. 3A.

TABLE 1

| Parameter | Transfer Region | Midspan Region | Reinforcing Material | Binder |
|---|---|---|---|---|
| inner layer | 0.025" (.6 mm) | 0.025" (.6 mm) | AW370-5H no tracers carbon cloth fabric | Hercules HBRF-55A resin |
| ±10° fibers | 0.140" (3.5 mm) | 0.140" (3.5 mm) | AS4D-GP (12K) carbon fibers | Hercules HBRF-55A resin |
| 90° fibers | 0.235" (6.0 mm) | 0.041" (1.0 mm) | AS4D-GP (12K) carbon fibers | Hercules HBRF-55A resin |
| Total shell thickness | .400" (10 mm) | .200" (5 mm) | N/A | N/A |
| Diameter | 24" (610 mm) | 24" (610 mm) | N/A | N/A |
| Height | 144" (3.7 m) | 144" (3.7 m) | N/A | N/A |
| Cover to main bars | 1" (25.4 mm) | N/A | N/A | N/A |
| Starter bars | 20 #7 | N/A | G60 steel | N/A |
| Concrete core | Std. | Std. | N/A | N/A |

Example 2 ("CS2")

The fiber-reinforced composite structural member of Example 2 was also produced at Plant No. 2 filament winding facility at Hercules Aerospace Company using processes and materials similar to that described above in connection with Example 1. In this case, however, the shell was formed having uniform thickness along its length and being composed of mostly ±10° fibers, as determined by design capacity requirements. This is because the structural member constructed in accordance with Example 2 was designed to extend directly into the footing as shown in FIG. 3B. Also, ribs were not provided on the interior of the shell of Example 2, since no starter bars were used in this case to secure the composite member to a footing.

The CS2 shell was assembled on-site (UCSD test-site) and filled with concrete as shown and described above in connection with FIG. 3B. Table 2, below summarizes the various parameters of the fiber-reinforced composite structural member constructed in accordance with Example 2 and as illustrated in FIG. 3B.

TABLE 2

| Parameter | Transfer Region | Midspan Region | Reinforcing Material | Binder |
|---|---|---|---|---|
| inner layer | .084" (2.1 mm) | .084" (2.1 mm) | AW370-5H no tracers carbon cloth fabric | Hercules HBRF-55A resin |
| ±10° fibers | .356" (9.0 mm) | .356" (9.0 mm) | AS4D-GP (12k) carbon fibers | Hercules HBRF-55A resin |
| 90° fibers | .020" (.5 mm) | .020" (.5 mm) | AS4D-GP (12k) carbon fibers | Hercules HBRF-55A resin |
| Total shell thickness | .460" (12 mm) | .460" (12 mm) | AS4D-GP (12k) carbon fibers | Hercules HBRF-55A resin |
| Diameter | 24" (610 mm) | 24" (610 mm) | N/A | N/A |
| Height | 144" (3.7 m) | 144" (3.7 mm) | N/A | N/A |
| Cover to main bars | N/A | N/A | N/A | N/A |
| Starter bars | N/A | N/A | N/A | N/A |
| Concrete core | Std. | Std. | N/A | N/A |

FIGS. 6A–6D show the ductile response characteristics of the composite members constructed in accordance with Examples 1 and 2 and assembled in accordance with FIGS. 3A and 3B, respectively, versus a conventional steel reinforced column ("as built"). The test columns were each supported on a square footing of 5.5 feet on the sides and 19 inches (483 mm) deep for Example 1 and the as-built column, and 36 inches (914 mm) deep for Example 2. The as-built column contained 20 #7 G60 steel bars of continuous longitudinal reinforcement, corresponding to a longitudinal steel ratio of 2.66% with a clear cover to main bars of about 1 inch (25.4 mm). Transverse reinforcement was provided by #3 G60 steel spiral with a pitch of 2.25 inches (57 mm).

Each test column was subjected to a constant axial load of 400 Kips (1780 KN) corresponding to the design load and cyclical lateral loads simulating a unidirectional seismic attack. The axial load was applied to each column by high-strength bars pretensioned to the test floor. The lateral load was imparted to the top of each column by a fully reversing hydraulic actuator. Each column was initially tested at increasing load displacements stepped at increments of 12.5 kips (55.6 KN) and then by displacement control.

Figure 6A:
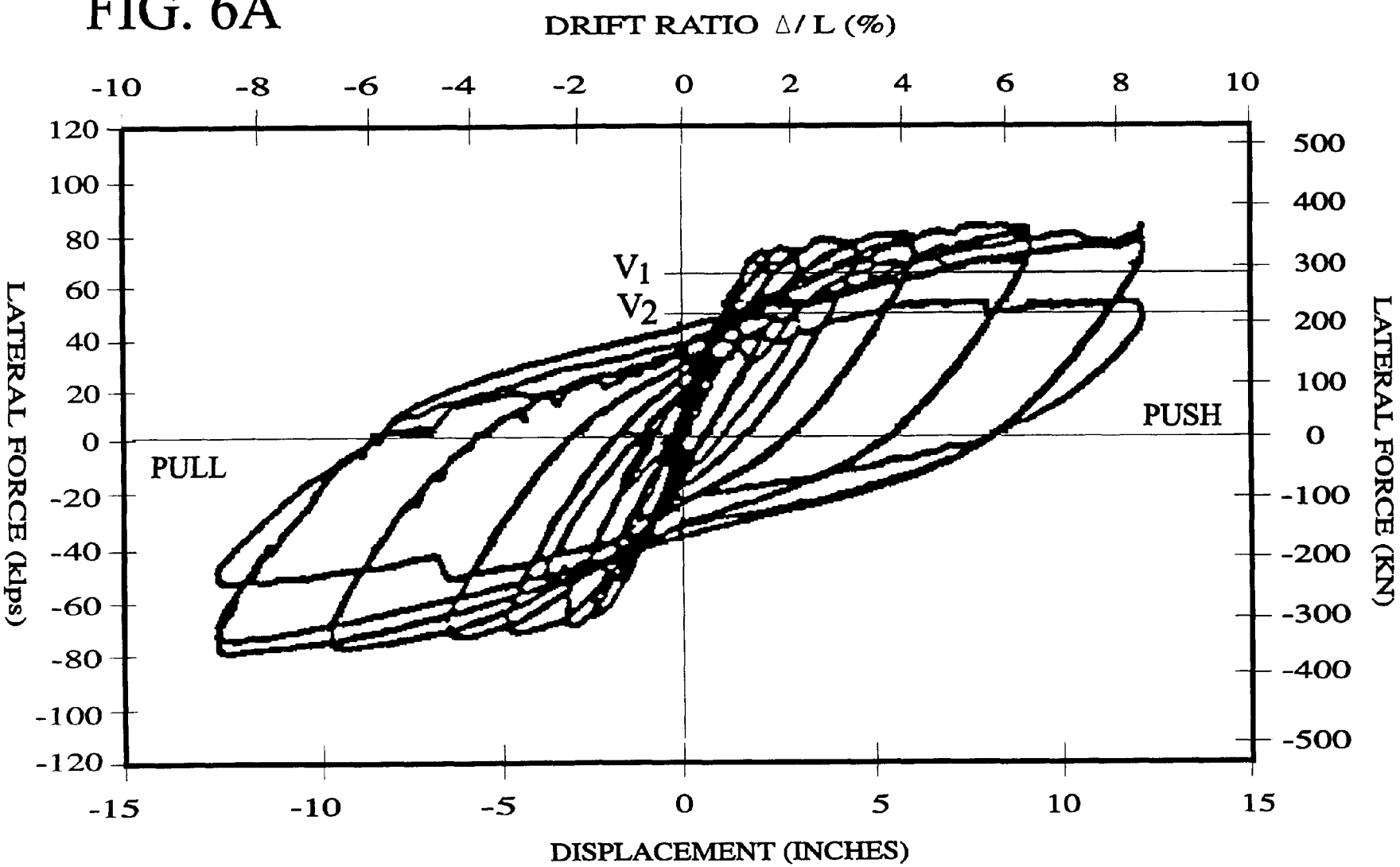
FIG. 6A is a load-displacement diagram of a conventional steel reinforced concrete column subjected to a lateral load.
Figure 6B:
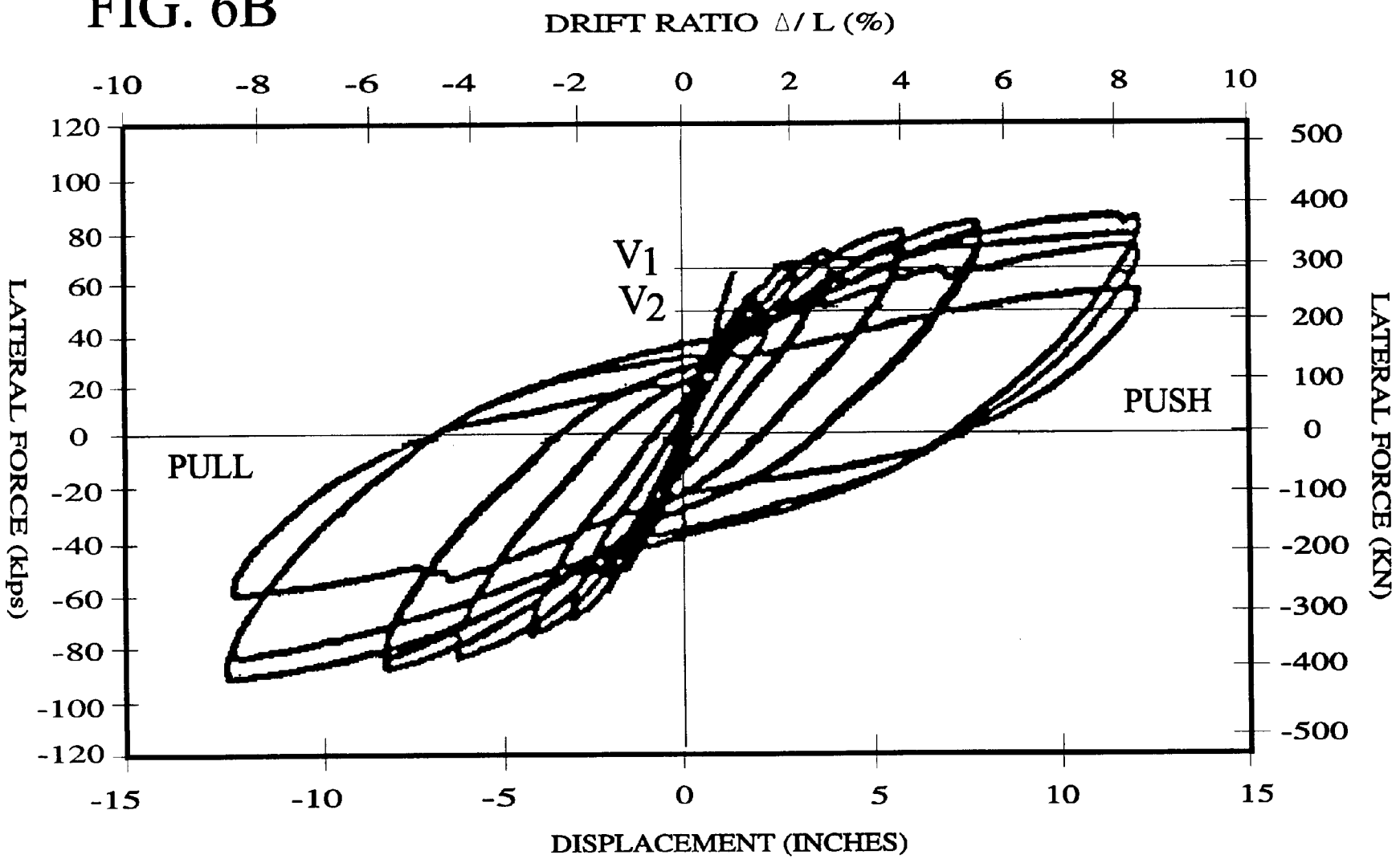
FIG. 6B is a load-displacement diagram of a fiber-reinforced composite column constructed in accordance with FIG. 3A and subjected to a lateral load.

FIG. 6B shows the force displacement curve of the column constructed in accordance with Example 1. The column displays a stable, hysteretic load-displacement characteristic up to failure. A maximum top displacement of 12.4 inches (315 mm) corresponding to a drift ratio of ($\Delta l/l$ of 8.6%) was reached just prior to the onset of failure.

Figure 6C:
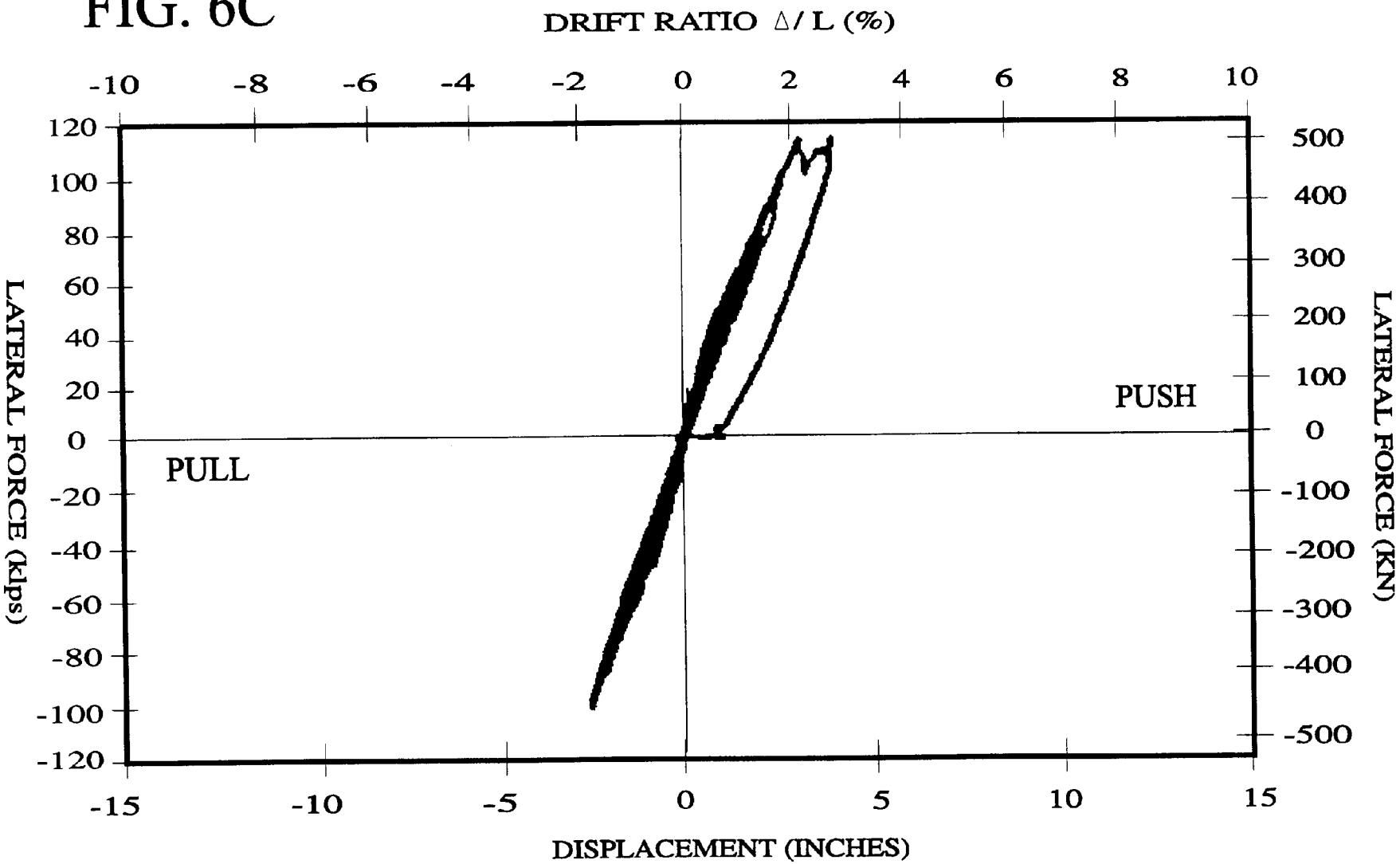
FIG. 6C is a load-displacement diagram of a fiber-reinforced composite column constructed in accordance with FIG. 3B and subjected to a lateral load.

FIG. 6C shows the force displacement curve of the column constructed in accordance with Example 2. In this case, the behavior of the column was essentially linear elastic, as shown, up to an applied load of about 37.4 kips (166 KN) and a top displacement of 0.53 inches (13 mm). The maximum load response was achieved at 115 kips (512 KN) with a top displacement of 3.05 inches (77.5 mm). A slight nonlinear response was noted and is believed to be due to the effects of slipping of the fiber-reinforced composite shell out of the footing block and the resultant debonding of the concrete core.

Figure 6D:
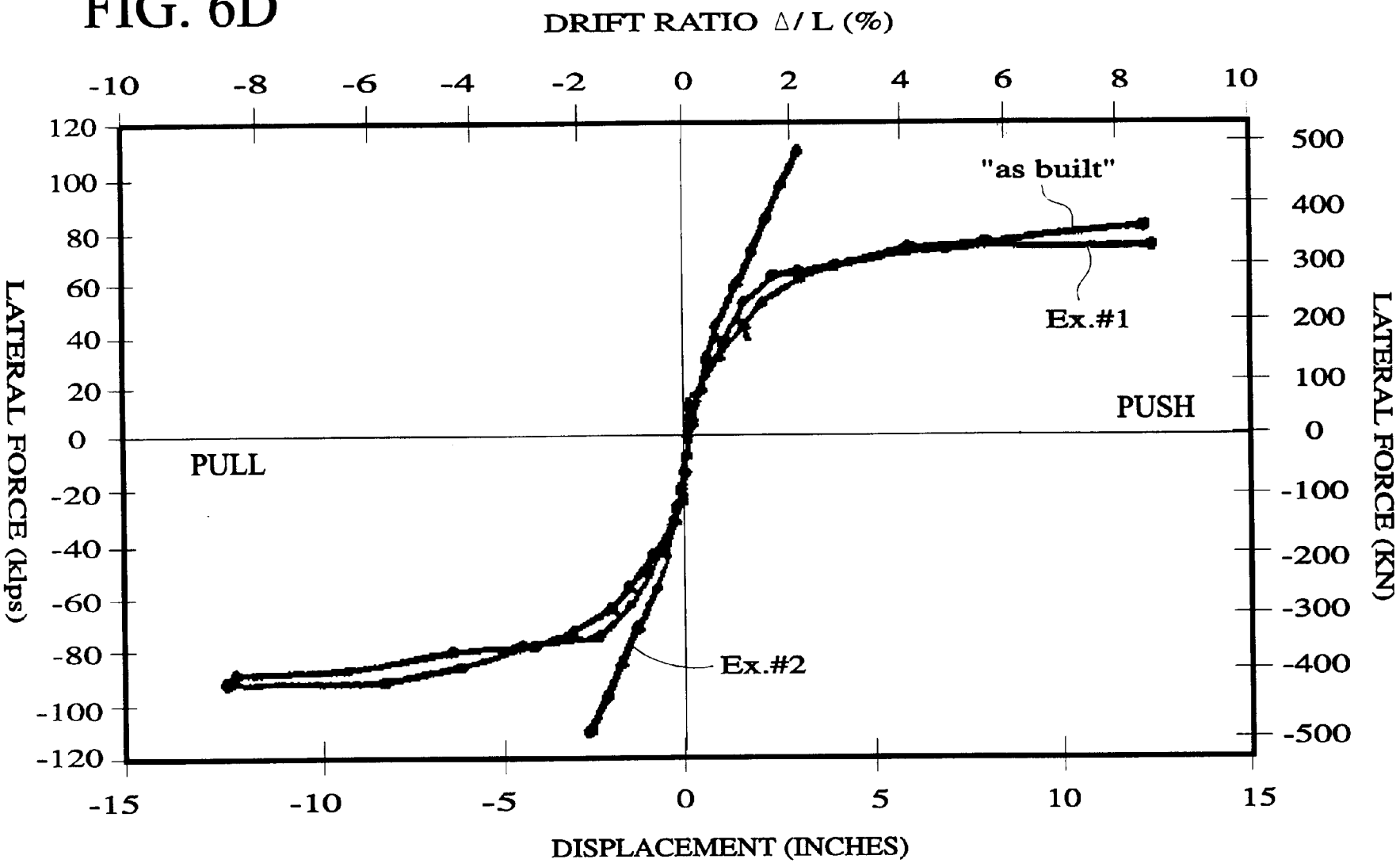
FIG. 6D is a comparison chart of the various load-displacement responses illustrated in FIGS. 6A–6C.

FIG. 6D summarizes the force displacement envelope of each of the test columns. As indicated, the test column constructed in accordance with Example 1 was found to have very nearly the same force displacement curve as the conventional as-built column. The test column constructed in accordance with Example 2 had a somewhat steeper response curve, as shown, indicative of increased rigidity and decreased ductility of the composite member.

TABLE 3 below summarizes the average mechanical properties of the fiber-reinforced composite structural members constructed and tested in accordance with Examples 1 and 2, above:

TABLE 3

| Property | Example 1 | Example 2 |
|---|---|---|
| Fiber volume ratio | 61.9% | 53.4% |
| Resin volume ratio | 34.4% | 42.2% |
| Void volume ratio | 3.7% | 4.4% |
| Axial tension modulus | 14580 ksi (100.5 gpa) | 15030 ksi (103.6 gpa) |
| Axial tension strength | 86.00 ksi (592.9 MPa) | 86.58 ksi (596.9 MPa) |
| Axial compression modulus | 14580 ksi (100.5 gpa) | 13410 ksi (92.46 gpa) |
| Axial compression strength | 53.84 ksi (371.2 MPa) | 70.19 ksi (483.9 MPa) |

Assembly/Connectors

Various methods and connection devices may be used to assemble the fiber-reinforced composite structural members of the present invention to form a support frame or space truss structure. It is preferred, however, to use one of several improved connectors particularly suited to provide a high-integrity structure having desired strength and/or compliance characteristics, as needed. Examples of several such improved connectors and connection techniques are illustrated in FIGS. 7A–14D, described in more detail below.

Figure 7A:
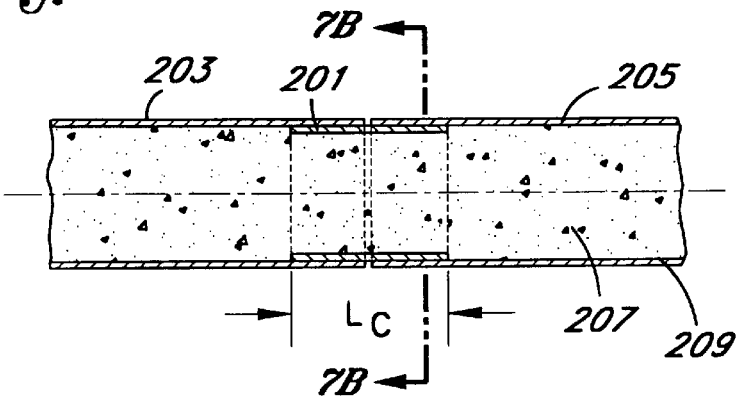
FIGS. 7A and 7B are longitudinal and transverse cross-section views, respectively, of a splice connector having features of the present invention.

FIGS. 7A–13B illustrate various splice connectors for joining one concrete-filled fiber-reinforced composite member to another in an axial relation. Such connections may be used, for example, to join multiple fiber-reinforced composite members together to create a truss span member or other structural support member, as needed. FIGS. 7A and 7B illustrate the use of an internal coupler 201 to join two adjacent fiber-reinforced shells 203, 205. The coupler 201 is preferably formed of a fiber-reinforced composite material having strength and compliance comparable to that of the shells to be joined.

The coupler 201 has an outer diameter D which allows it to fit securely inside the ends of each shell 203, 205. The coupler 201 is secured to each shell 203, 205 by use of a suitable adhesive such as an epoxy. Alternatively, mechanical fasteners or other convenient expedient may be used. The coupler 201 has a length $L_c$ which allows the coupler to extend a distance ½ $L_c$ into each adjacent shell. This distance is selected to provide adequate bonding area between each shell and the coupler 201 so that the coupler will not pull-out at maximum design load. A coupler 201 having a length L between about 0.5D to 2D, and more preferably about D, should provide adequate results for most applications, depending upon the particular adhesive selected to bond the shells to the coupler.

Once the shells 203, 205 are secured to the coupler 201, the resulting structure can be filled with concrete to form the desired composite structure. Optional grout openings (not shown) may be provided as needed to allow for pumping of concrete into the shells 203, 205 as needed. Grout openings may be formed on site by means of cutting, drilling, or machining operations, or they may be provided in the form of small openings or "knockouts" which can be selectively cut-out on-site and laminated back in-place after grouting.

In an alternative embodiment, it is envisioned that the coupler 201 could be integrally formed on one end of either shell 203 or 205. In this manner prefabricated shells could be provided which can be joined to one another simply by inserting one male end of one shell into the female end of another shell to form a continuous composite member.

Figure 8A:
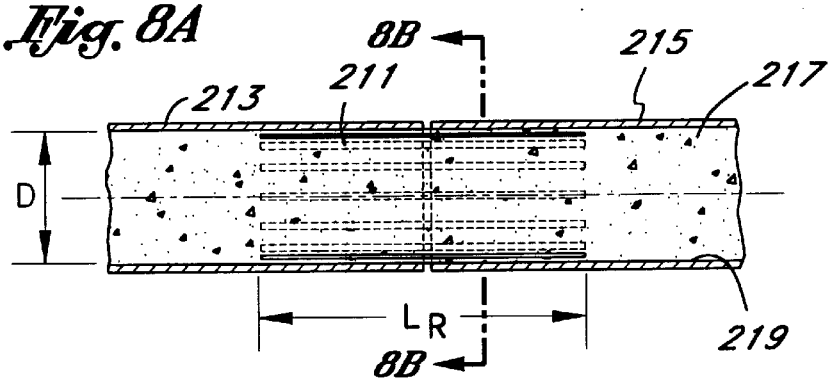
FIGS. 8A and 8B are longitudinal and transverse cross-section views, respectively, of an alternative embodiment of a splice connector having features of the present invention.
Figure 8B:
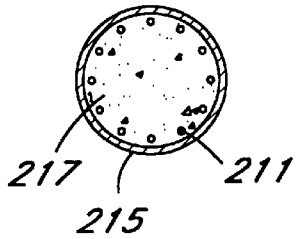

FIGS. 8A and 8B illustrate an alternative splice connector and method for joining adjacent shells 213, 215 of diameter D. In this method a plurality of connector bars 211 of length L are provided between the two shells to be joined such that they extend into each of the shells 213, 215 a distance ½ L, as shown. A suitable connector bar length of L=D to 4D, and more preferably about 2D, should provide adequate results for most applications. The connector bars 211 may comprise any of a number of conventional mild-steel or fiber composite reinforcements known to those skilled in the art. For instance, #7 G60 steel bars may be used. Alternatively, the connector bars may comprise prestressed or hardened steel or fiber composite materials as desired, depending upon strength and compliance requirements of the joint.

For joining composite column members the connector bars 211 may be first cast in place in the lower shell member. Once the concrete in the lower shell has set sufficiently the second shell can then be secured in place over the extended ends of the connector bars 211, the combined structure being filled with concrete to a desired level. For joining composite beams and angled members, it may be necessary to secure the connector bars in place using adhesives, spacers or other suitable expedient.

Preferably, the shells 213, 215 are formed with ribs on at least a portion of the inner surface 219 thereof to ensure adequate mechanical bonding to the concrete-encased connector bars in the plastic hinge region. For post-tensioning, an optional seal or expansion joint (not shown) may be provided at the interface between the adjacent shells 213, 215 in order to seal the concrete core 207 during pouring and to provide a compliant compression interface between adjacent shells to prevent crushing of the shells during bending.

Figure 9A:
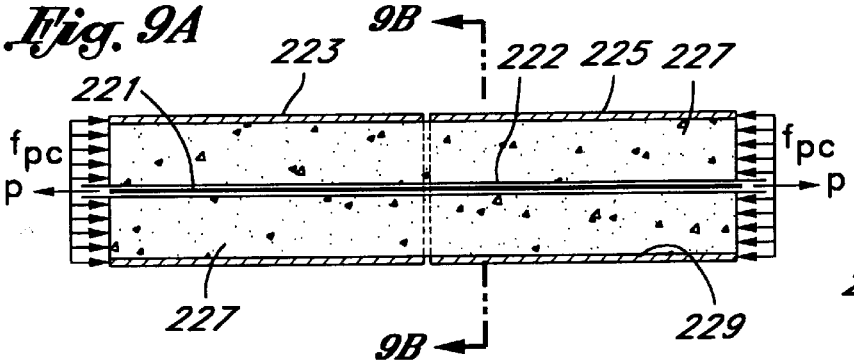
FIGS. 9A and 9B are longitudinal and transverse cross-section views, respectively, of another alternative embodiment of a splice connector having features of the present invention.
Figure 9B:
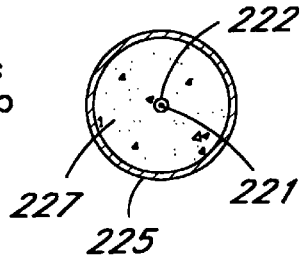

FIGS. 9A and 9B show an another alternative embodiment of a splice connector for joining adjacent shells 223, 225. In this method the shells 223 and 225 are aligned axially and brought into abutment with one another, as shown. A post-tensioning bar or cable 221 is positioned running axially through the two shells 223, 225, being secured by suitable tension-adjustment anchors (not shown). The post-tensioning bar 221 may comprise one or more tendons fabricated from a steel or other suitable material as desired. An optional sleeve 222 such as corrugated sheathing or PVC pipe may be provided around the tension bar 221, if desired, to prevent it from initial bonding to the concrete core 227. Once the post-tensioning bar(s) are in place, the shells 223, 225 are then filled with the concrete core 227 and the combination is allowed to cure. The tensioning bar is then tightened or adjusted to force the composite members together with a predetermined force.

Again, an optional seal or expansion joint (not shown) may be provided between the abutting surfaces of the shells 223, 225 in order to seal against seepage of wet concrete, and also to provide an expansion joint or compression joint so as to limit crushing of the fiber-reinforced composite shells during normal flexure and bending thereof.

Figure 10A:
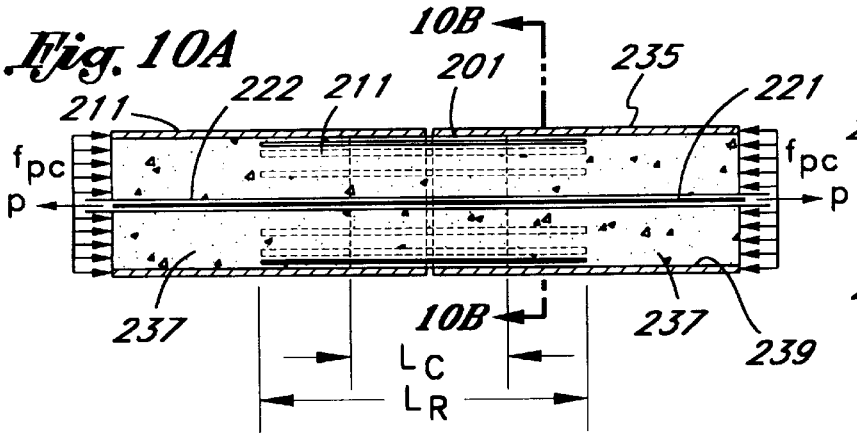
FIGS. 10A and 10B are longitudinal and transverse cross-section views, respectively, of another alternative embodiment of a splice connector which combines the features of the splice connectors shown in FIGS. 7–9.
Figure 10B:
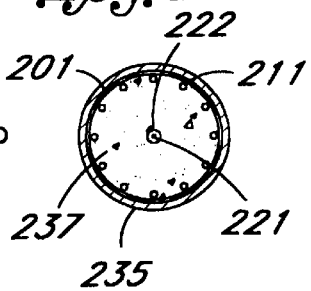

FIGS. 10A and 10B illustrate a splice connector and method which combines the various features and advantages of the connectors and connection techniques discussed above in connection with FIGS. 7–9.

Figure 11A:
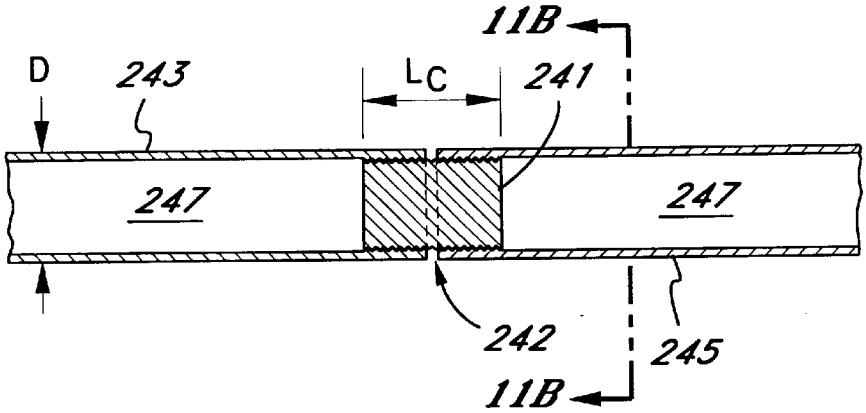
FIGS. 11A and 11B are longitudinal and transverse cross-section views, respectively, of another alternative embodiment of a splice connector having features of the present invention.
Figure 11B:
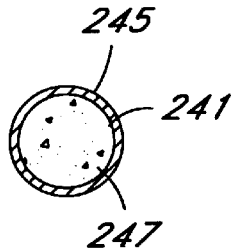

FIGS. 11A and 11B illustrate a threaded splice connector for joining adjacent fiber-reinforced composite shells 243, 245 of diameter D. The coupler 201 is preferably formed of a fiber-reinforced composite material having strength and compliance capacity comparable to that of the adjacent shells to be joined. The ends of each adjacent shell 243, 245 is formed having internal threads corresponding to the external "screw-jack" threads formed on the threaded coupler 241. These threads may be formed in a similar manner to the ribs described previously, or in accordance with other well-known fiber composite fabrication techniques such as disclosed in U.S. Pat. No. 5,233,737.

The length $L_c$ of the threaded coupler 241 is preferably long enough to prevent pull-out of the shells/coupler at design load, taking into account the shear strength of the threads. A length $L_c$ of about 0.5D to 2D, and more preferably about D should produce suitable results for most purposes. Optionally, the threaded coupler 241 may be bonded to the shells 243, 245, as desired, to provide even more secure attachment thereto.

For post-tensioning, an optional compression joint or expansion joint (not shown) may be provided between the abutting surfaces of the fiber-reinforced shells 243, 245 in order to prevent crushing of the shells during flexure or bending thereof. Alternatively, a gap 242 may be provided between opposing surfaces of the shells 243, 245 to allow for length adjustments during construction and assembly. Once the shells are positioned in place, the threaded coupler 242 is rotated like a screw-jack to pull the shells together. The combined structure is then filled with concrete 247 to form the resulting composite beam or column.

Alternatively, it is envisioned that the threaded coupler 241 can be formed integrally with either one of the shells 243, 245, such that one end of each shell has a male threaded end, and an opposite end of a mating shell has a corresponding female threaded end. This may be done in the shell fabrication process itself or by factory bonding a separate threaded coupler to the end of the prefabricated shell. In this manner, prefabricated shells can be assembled together to form a structure simply by threading the male end of one shell into the female end of another adjacent shell. This may have particular advantage for pre-fabricated modular shells for general purpose use.

Figure 12A:
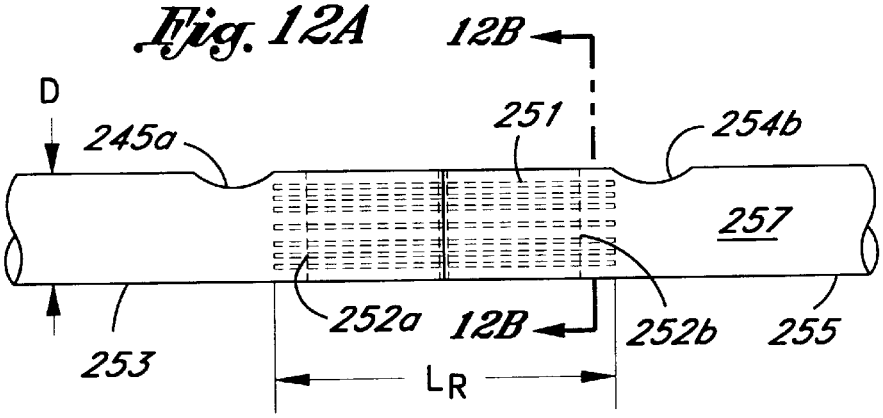
FIGS. 12A and 12B are longitudinal and transverse cross-section views, respectively, of another alternative embodiment of a splice connector having features of the present invention.
Figure 12B:
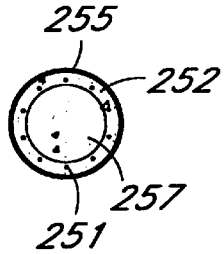

FIGS. 12A and 12B illustrate one possible variation of the splice connector shown in FIGS. 8A and 8B particularly adapted for use in horizontal or angled composite beam members. In this method spacer rings 252*a,b* are used to support the peripherally spaced connector bars 251 in the desired configuration while the shells are filled with concrete. Again, access or grout holes 254 may be provided for adjusting the connector bars and for allowing pumping of concrete into horizontal or angled shells 253, 255 while ensuring adequate filling in the area of the connector bars 251.

As shown in FIG. 12B, the spacer rings 252*a,b* are preferably an annular ring formed of a suitable material and having an outer diameter approximately equal to the corresponding inner diameter D of the shells 253, 255. A plurality of spaced openings are provided along a central periphery thereof for accommodating insertion and support of the connector bars 251.

During assembly, one spacer 252*a* may be inserted into the end of the corresponding shell 253 to a depth sufficient to receive and support the connector bars 251. The connector bars are then inserted into the corresponding holes in the spacer 252*a* so that they are supported in an annular spaced fashion. A second spacer ring 252*b* is then placed over the other ends of the connector bars 251 so as to form a cylindrical cage. The shell 255 is then fitted over the end of the spacer ring 252*b* and reinforcement bars 251 and supported in place, as shown. The joined shells can then be filled with concrete 257 to form the composite beam, as desired.

Alternatively, concrete may be pumped only into the plastic hinge regions as desired to ensure adequate connection of the composite beams. For example, it may be desirable to leave one or both of the shells 253, 255 empty throughout the midspan region such that beam support is provided only by the inherent strength of the fiber-reinforced shell. This may be desirable, for instance, where the beams are not required to carry substantial bending or compression loads or where the beams support only tension loads. This feature may have particular advantage for saving concrete material costs and for constructing lightweight frames in seismic regions where is desirable to minimize the seismic excitation mass of the resulting structure. For this purpose a plug or disk (not shown) may be inserted to the left and right of grout access holes 254*a*, 254*b*, respectively, to block penetration of the concrete into the mid-span regions of shells 253, 255 if it is desired to leave them empty.

Figure 13A:
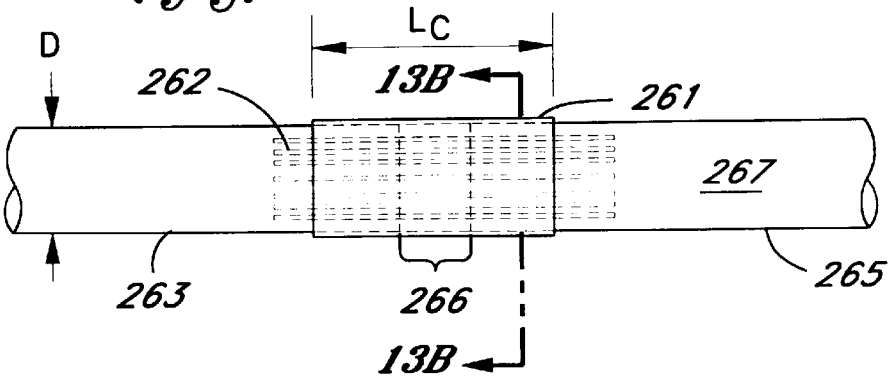
FIGS. 13A and 13B are longitudinal and transverse cross-section views, respectively, of another alternative embodiment of a splice connector having features of the present invention.
Figure 13B:
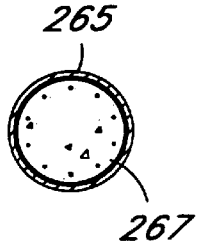

FIGS. 13A and 13B show another alternative embodiment of a semi-ductile splice connector for connecting adjacent shells 263, 265 of diameter D using a sliding hinge coupler 261. The hinge coupler 261 is preferably formed of a fiber-reinforced composite material having strength and compliance characteristics comparable to that of the shells to be joined. The hinge coupler 261 has a diameter slightly larger than thee diameter of the shell 263, 265 such that it may be slid over the end of each shell. The hinge coupler 261 has a length $L_c$ sufficient to allow adequate overlap with the shells for required bonding and to allow for any gaps 266 between adjacent shells. A hinge coupler 261 having a length $L_c$ between about D to 4D, and more preferably about 2D, should provide adequate results for most applications, depending upon the size of the gap 266 and particular adhesive selected to bond the shells to the coupler.

During assembly, the sliding hinge coupler 261 is inserted over the end of one of the shells 263 or 265, with the opposing shell 265 positioned as shown. Due to construction tolerances, a gap 266 is often between adjacent shells. With the shells axially aligned, the hinge coupler 261 is slid over the shells 263, 265 bridging the gap 266, as shown. The shells are then filled with concrete to form the composite structure. For added strength, optional reinforcement bars 262 may be secured in place, as desired, using any one of the methods described above.

FIGS. 14A–14D show a cruciform connector having features of the present invention for providing transverse or angled connections between one or more composite structural members. While a planar cruciform connector 301 is shown, those skilled in the art will appreciate that a wide variety of other planar or spacial connector shapes and sizes may be used in accordance with the teachings of the present invention, such as corners, angles, "L's, T's, etc. Preferably, these may be prefabricated as standard modular elements which can be stocked and ordered from a catalog for building modular composite structures.

The cruciform connector shown comprises a vertically oriented connector body 303 formed as a fiber-reinforced shell and extending axially along the "z" axis. The length of the connector body 303 may be varied as desired, taking into account bonding strength requirements at design capacity. For a prefabricated connector, for example, it is desirable to provide a relatively short connector body length to minimize size and weight so that standard connectors can be manufactured, stocked and shipped inexpensively. Preferably, such prefabricated connectors are of sufficient size and shape such that they can be handled by a single construction worker on site. For on-site fabrication, on the other hand, the length of the connector body 303 becomes less important since the connector body 303 will most likely comprise the midspan region of an adjacent composite column member.

Connector extensions 305*a,b* extend transversely from the vertical body 303 at a desired angle to provide a suitable structure for connecting adjacent shells 307, 309, as described herein. The connector extensions 305*a,b* are each cut on one end to form a transverse cylindrical surface adapted to mate with the outer cylindrical surface of the connector body 303 and are preferably bonded in place using a suitable adhesive and/or fiber lamination. Preferably, the inner surface of each connector extension 305*a,b* has ribs formed thereon for providing good mechanical bond between the concrete core 314 and the connector body 303 as described herein.

Connector bars 309 and sliding hinge sleeve 311*a*, 311*b* provide a plastic hinge connection between adjacent beam members, as shown. Hinge sleeves 311*a,b* are preferably formed of a suitable fiber composite material comprising primarily hoop fibers sufficient to maintain adequate confinement pressure on the concrete core 314. The sleeves 311*a,b* preferably have a diameter equal to or slightly larger than that of the corresponding shell 307 and connector extensions 305*a* and 305*b* so that they may be slid over the ends thereof.

Figure 14A:
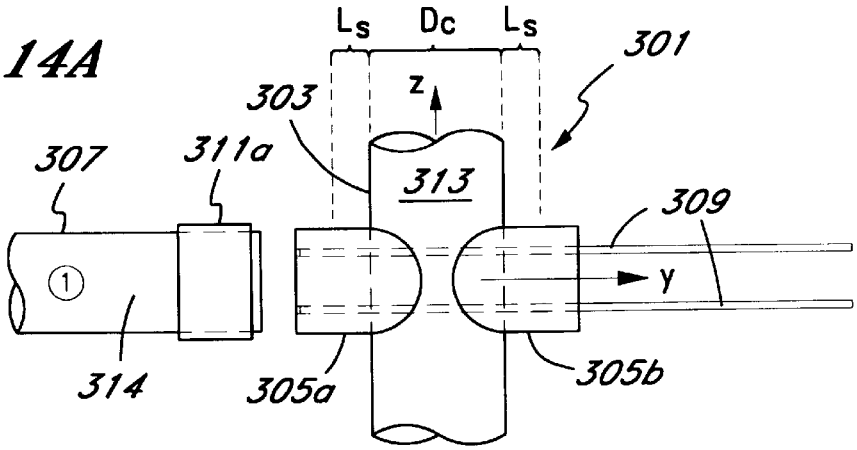
FIGS. 14A–14D are time-sequenced front-elevational views illustrating typical use and assembly of a cruciform hinge connector having features of the present invention.
Figure 14B:
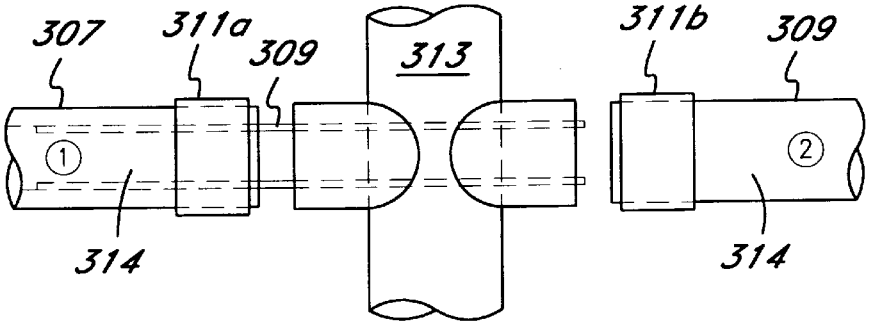
Figure 14C:
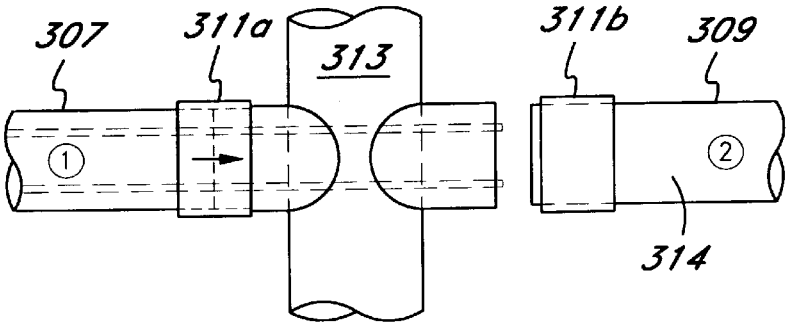
Figure 14D:
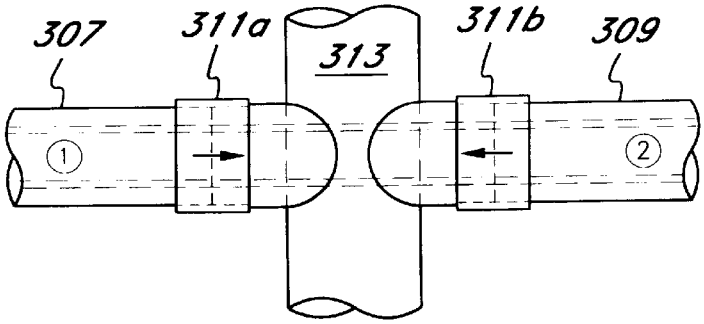

During assembly, the connector 301 is positioned or fabricated in place. Holes are formed transversely through connector body 303 to accommodate insertion of connector bars 309, which are passed through the connector body 303 and moved to one side as shown in FIG. 14A. An adjacent shell 307 having a sliding hinge sleeve 311*a* placed over the end thereof is brought into position adjacent its mating connector extension 305*a*. The reinforcement bars are then shifted to the other side of the connector body 303 so they extend into the shell 307. The second shell 309 is then moved into position as shown and having a corresponding sliding hinge sleeve 311*b* placed over the end thereof. Next, the connector bars 309 are centered and the shells 307 and 309 are mated with the connector extensions 305*a,b*, as shown in FIGS. 14C and 14D. The hinge sleeves 311*a* and 311*b* are then slid into place and centered over the interface between each connector extension 305*a,b* and corresponding shell 307, 309. Finally, the concrete core 314 is poured or pumped into each shell 307, 309 and allowed to cure to form the composite structure shown in FIG. 14D.

As noted above, the hinge sleeves 311*a,b* are preferably formed primarily using hoop fibers. Those skilled in the art will appreciated that the primary purpose of the sleeves 311*a,b* is to bridge any gaps between adjacent mating members and to provide increased hoop strength and confinement in the plastic hinge region of the shells and connector extensions to allow large plastic deformation capacities. Moreover, unlike the splice couplers shown in FIGS. 7A, 10A, 11A and 13A, the hinge sleeves 311*a,b* preferably do not provide significant resistance to bending stress, as this could limit the desired ductile response of the plastic hinge connector 301.

Alternatively, it may be desirable to provide a fully elastic or non-ductile connection between two or more adjacent composite structural members. This can be readily accommodated simply by modifying the connector 301 to utilize one or more of the splice connectors illustrated FIGS. 7A, 10A, 11A or 13A.

Space Frame Systems

Figure 15A:
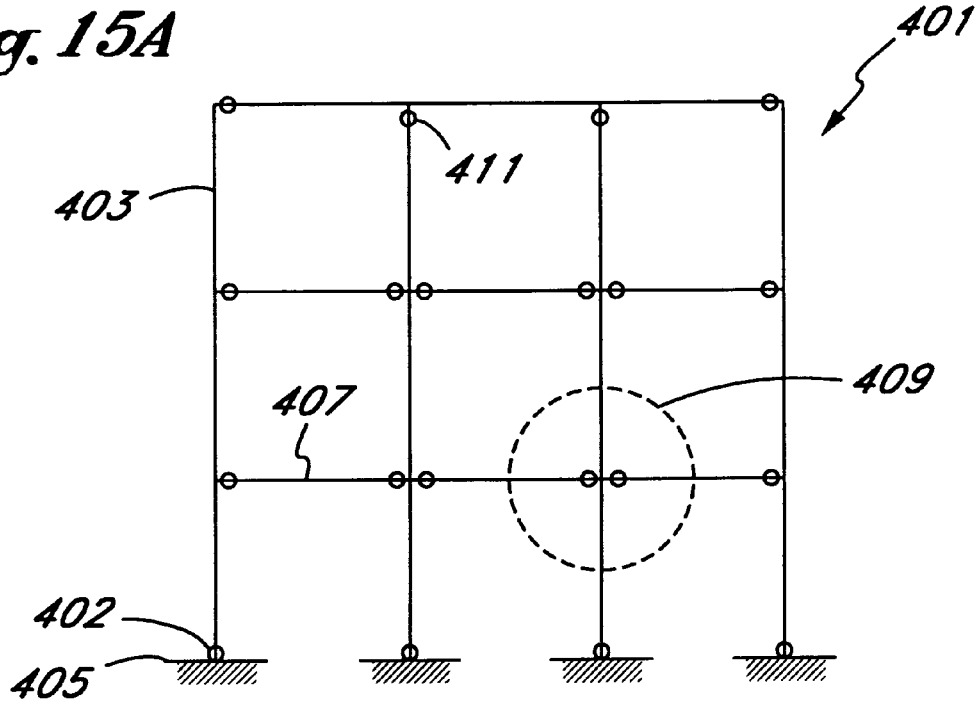
FIG. 15A is a schematic representational view of a fiber-reinforced space frame having beam plastic hinges constructed and assembled in accordance with the present invention.
Figure 15B:
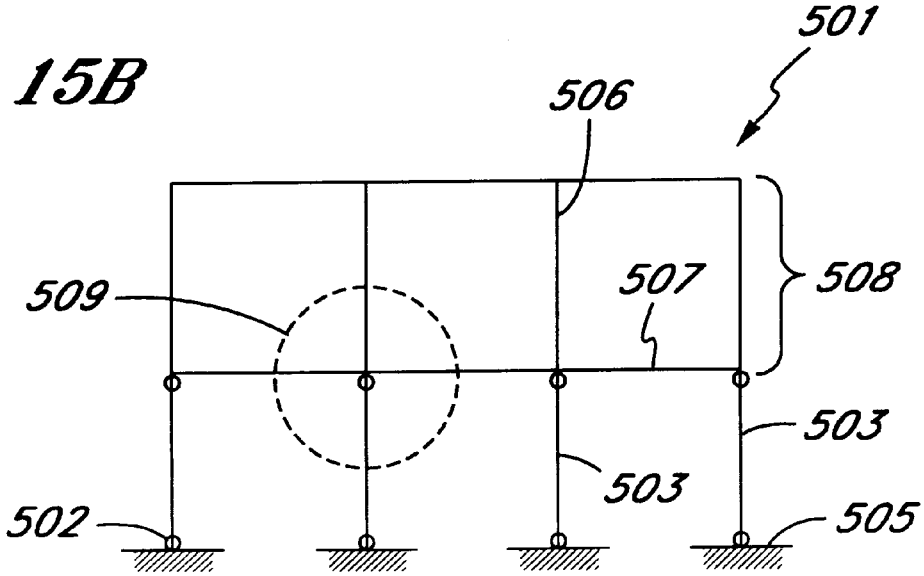
FIG. 15B is a schematic representational view of a fiber-reinforced space frame having column plastic hinges constructed and assembled in accordance with the present invention.

FIGS. 15A and 15B are schematic representational drawings illustrating two possible design construction techniques in accordance with the present invention using composite structural members and connectors as disclosed and described herein. While the structures are shown as planar, persons skilled in the art will readily appreciate that the drawings are representative of three-dimensional space-frame structures.

FIG. 15A shows a space-frame 401 comprising a plurality of composite structural members connected together using beam plastic hinges. The frame 401 comprises a plurality of vertical composite columns 403 connected to corresponding footings 405 via a suitable footing connector 402, such as shown in FIG. 3A. The composite columns 403 may be formed as continuous fiber-reinforced shells filled with concrete, or they may be assembled by connecting a plurality of shells using any of the various splice connectors shown in FIGS. 7–14. A plurality of beams 407 are secured between adjacent columns 403 using beam plastic hinge connectors 409, such as illustrated and described in connection with FIGS. 14A–14D. The individual composite column and beams members are assumed to be fully elastic or rigid, such that deformation response is provided only by the hinge connectors 405, 409, 411.

The collapse mode of the space frame 401 is full rotational collapse of the columns 403, with angular ductile deformation provided by the footing connectors 402, header connectors 411, and beam plastic hinge connectors 409. The frame construction technique shown in FIG. 15A is preferred for use in seismic regions because of the overall energy-absorption and ductile deformation capacity provided by plastic hinge connectors.

FIG. 15B illustrates a space-frame construction 501 having column plastic hinges 509. In this case, a rigid frame structure 508 comprising composite columns 506 and composite beams 507 is supported by a plurality of hinged support pylons 503 joined to the rigid frame 508 via a column plastic hinges 509. The columns 503 are attached to footings 505 using a suitable hinged footing connector such as shown in FIG. 3A.

The collapse mode of the structure 501 is a soft story mode collapse. Accordingly, this space-frame structure represents a relatively low-energy absorption structure having an isolated high-strength upper portion 508 and a limited ductile portion comprising the hinged pylons 503 joined to the upper portion 508 by column plastic hinge connectors 509. This construction technique using composite structural members may be desirable in non-seismic regions where maximum nominal strength is required or in seismic regions where it is desirable to isolate the rigid portion of the frame 508 from substantial seismic deformation.

Truss Bridle

Figure 16A:
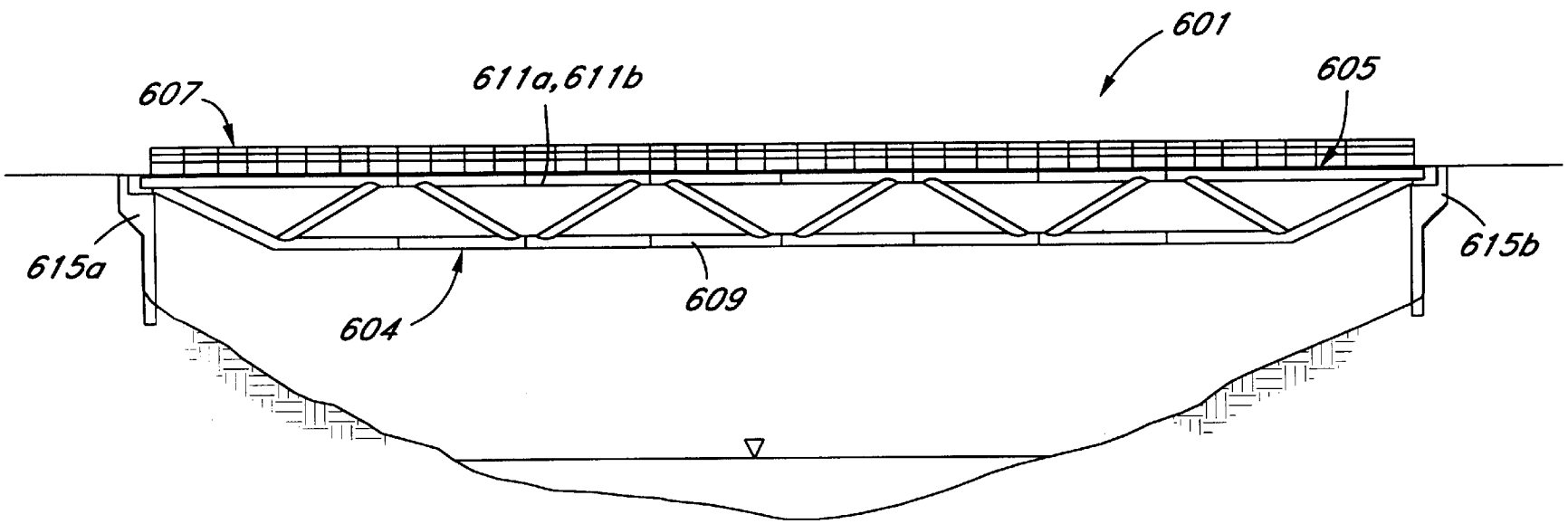
FIGS. 16A–16C are side-elevational, bottom-plan and transverse cross-section views, respectively, of a fiber-reinforced composite truss bridge constructed and assembled in accordance with the present invention.
Figure 16B:
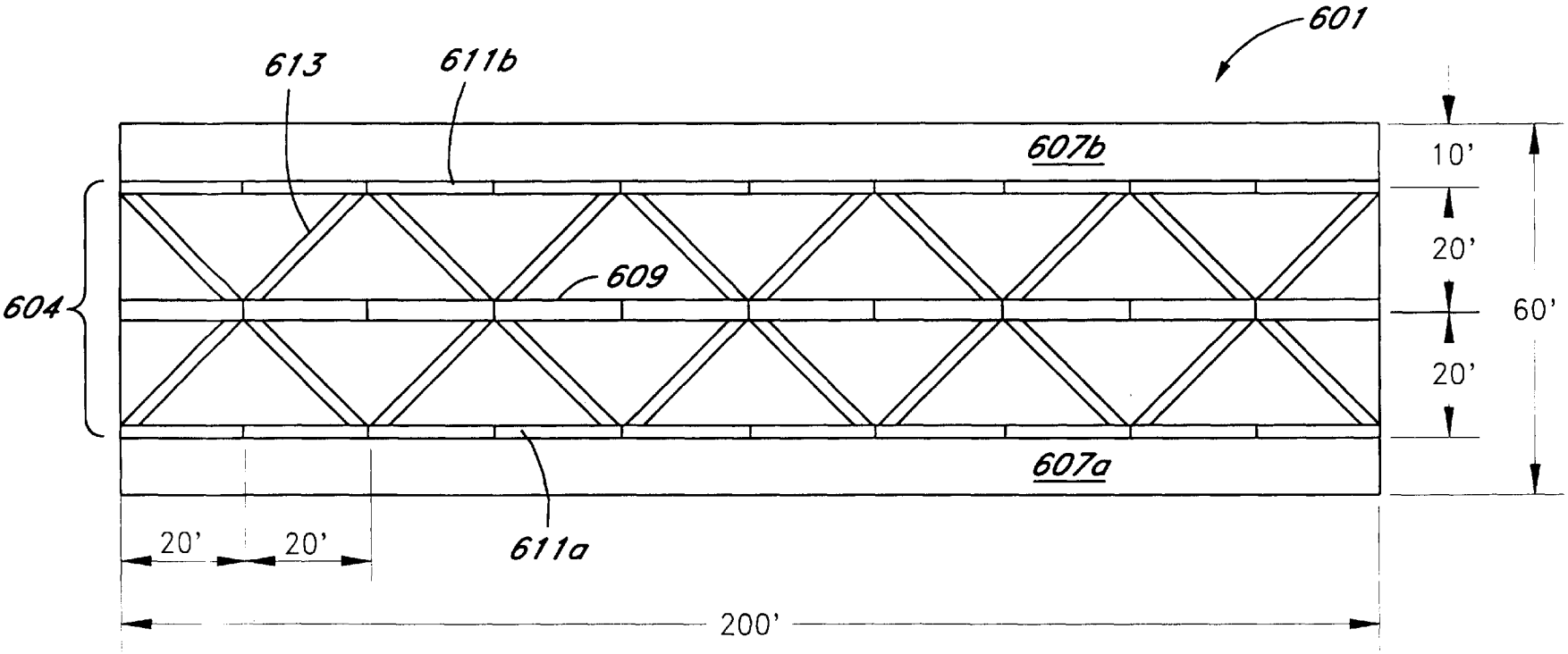
Figure 16C:
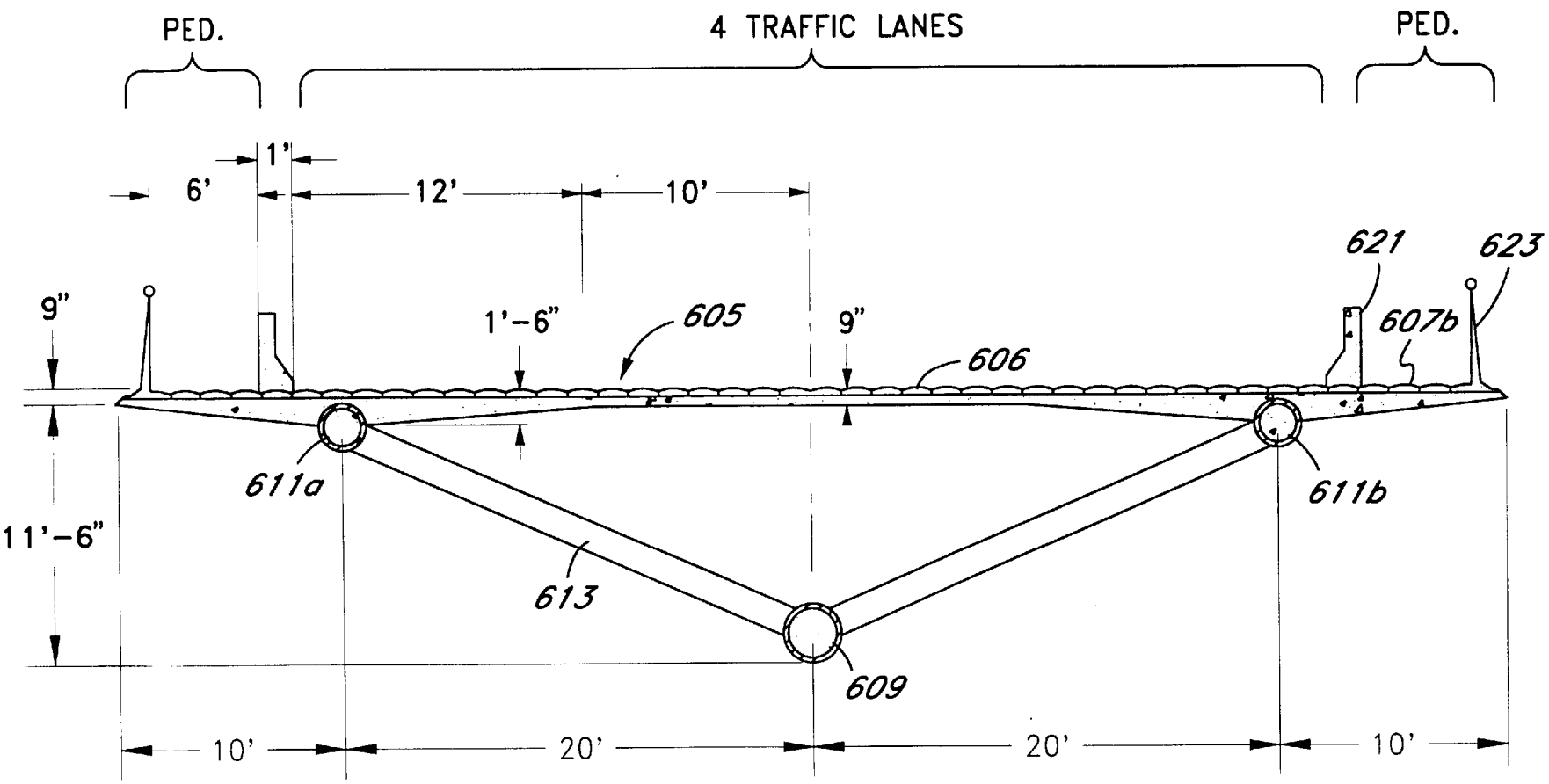

FIGS. 16A–16C illustrate one possible embodiment of a composite space frame structure in the form of a truss bridge 601 incorporating composite structural members in accordance with the present invention. FIG. 16A is a side elevational view of the truss bridge 601 comprising a three-dimensional space truss system which supports pre-cast, prestressed concrete panels 606. The truss bridge 601 comprises a plurality of interconnected fiber-reinforced shells forming a recessed space truss 604 below the roadway 605. The bridge 601 has an overall span of approximately 200 feet and is supported on either end by a pair of abutments 615*a,b*. A pedestrian walkway 607 is provided adjacent the road surface 605 on each side for pedestrian crossing.

Figure 7B:
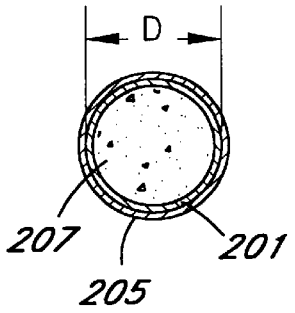

The space truss 604 is composed of a single bottom cord member 609 and two top cord members 611*a,b* and interconnecting truss members 613. The lower cord member 609 and the two top cord members 611*b* and 611*a* are formed from fiber-reinforced composite shells connected together by means of splice connectors, such as shown in FIGS. 7A and 7B. Alternatively, depending on the particular response requirements of the bridge structure 601, any one or combination of splice connectors or techniques shown in FIGS. 7–13 may be used to provide suitable ductile or elastic response as needed.

The lower cord 609 is a 3-foot diameter concrete-filled fiber-reinforced composite member which is post-tensioned to limit the tension stress in the fiber-reinforced composite shell. Some of the post-tensioning is continuous up into the abutments 615*a,b* to limit vertical deflection of the bridge. The post-tensioning system can be of either steel or fiber-reinforced cables/rods, depending upon cost, availability and anchorage techniques.

The two upper cords 611*a,b* are 1.5-foot diameter concrete-filled fiber-composite members. Compression is shared by the two upper cords 611*a.b* and by a prestressed, pre-cast concrete slab deck 606. The truss connector members 613 are also 1.5-foot concrete-filled fiber-reinforced composite shells which are connected between the upper and lower cords 611, 609 via suitable connection means, as described herein. Both the roadway surface 605 and the walkway 607 consist of pre-cast, prestressed concrete planks with a middle thickness of approximately 9 inches, as shown in FIG. 16C. A road barrier 621 and pedestrian railing 623 are provided to prevent injury to passengers and pedestrians traversing the bridge 601.

Arch Bridge

Figure 17A:
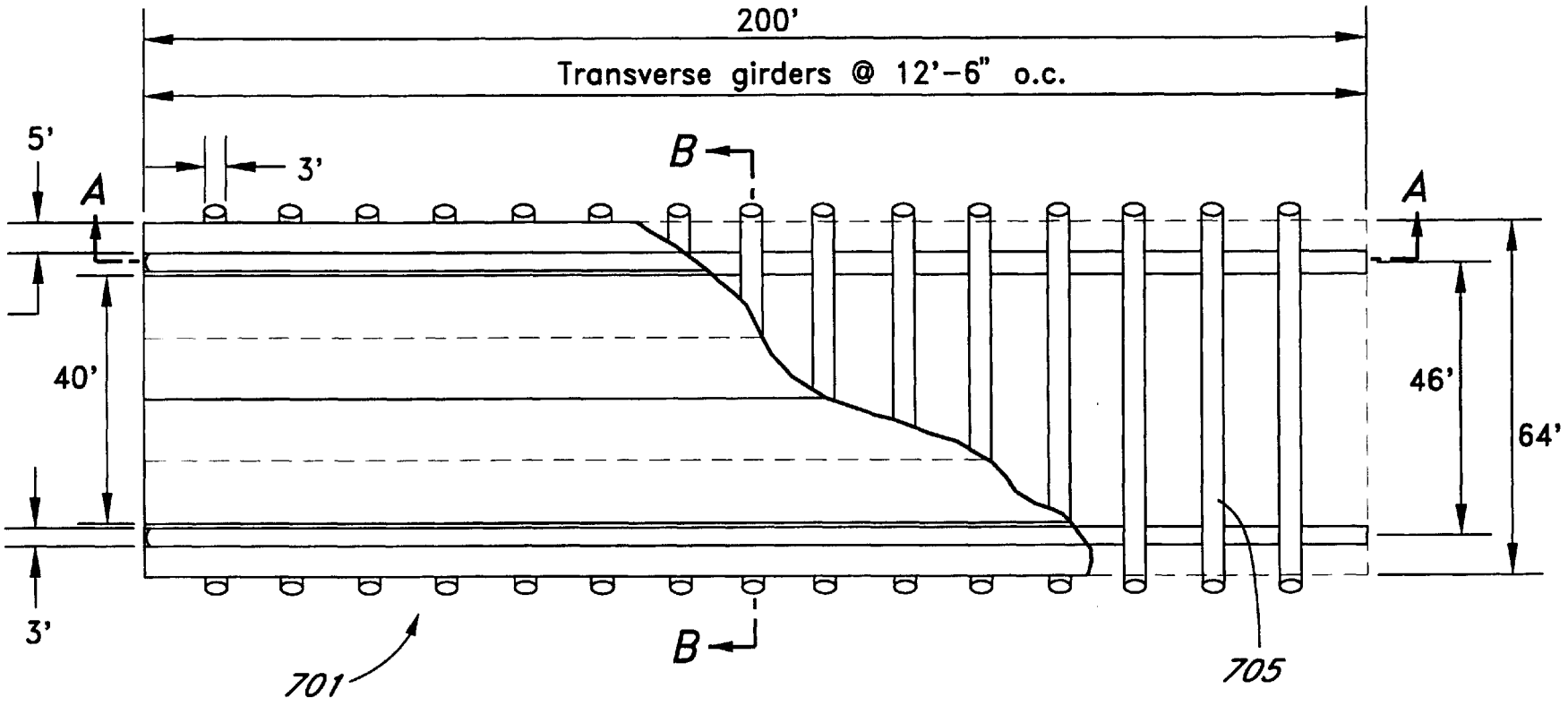
FIGS. 17A–17C are side-elevational, bottom-plan and transverse cross-section views, respectively, of a fiber-reinforced composite arch bridge constructed and assembled in accordance with the present invention.
Figure 17B:
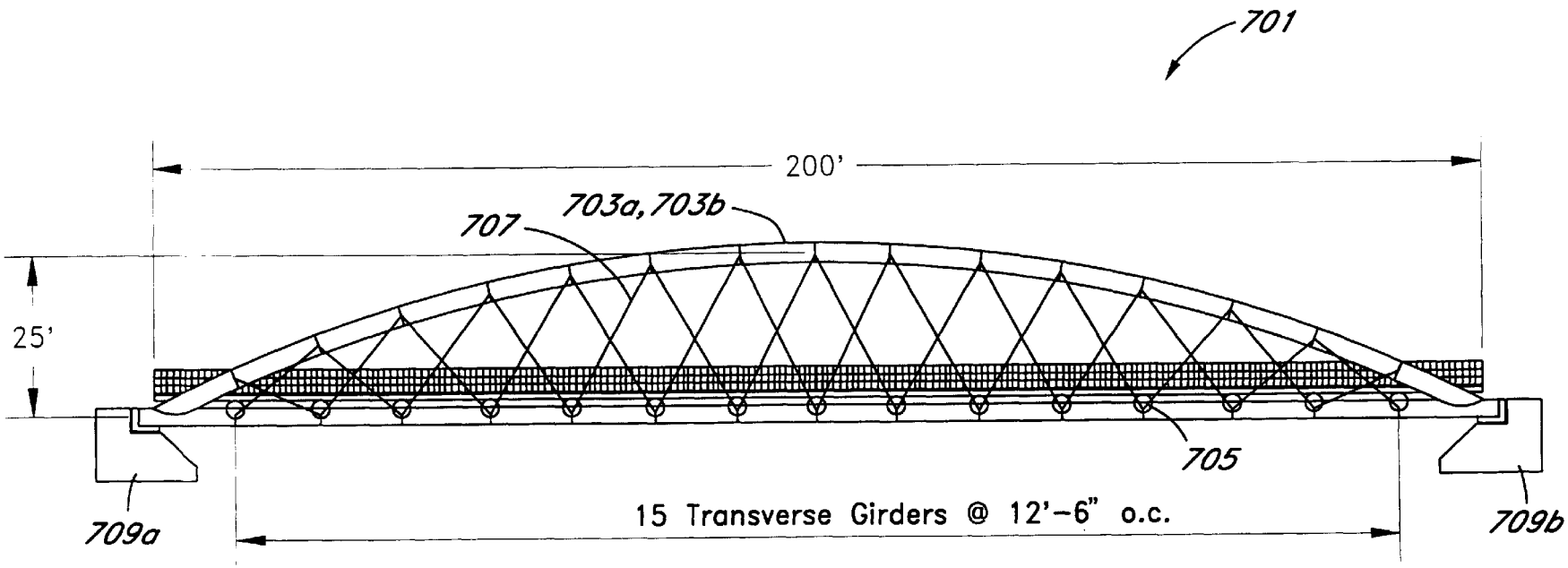
Figure 17C:
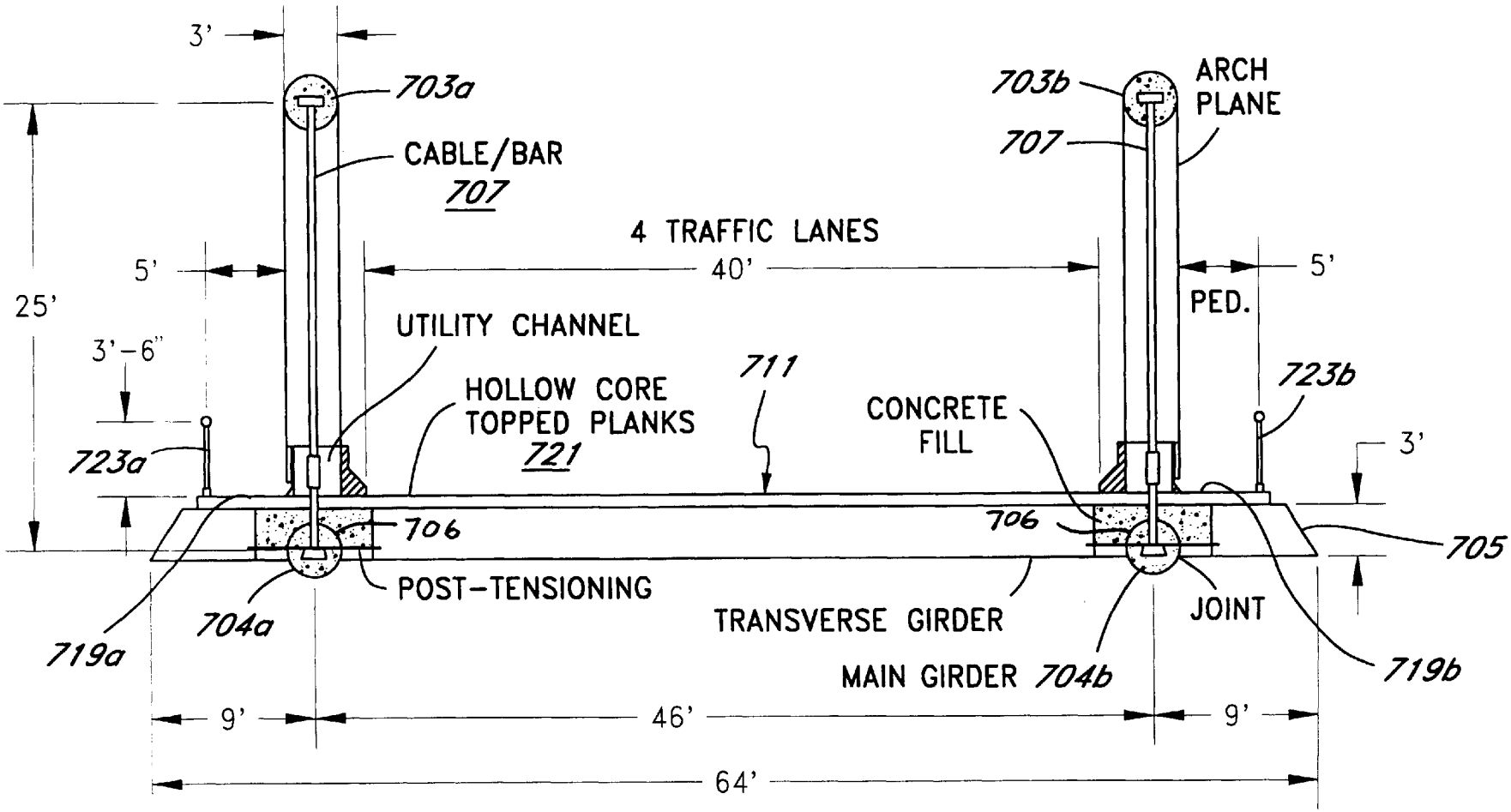

FIGS. 17A–17C illustrate another possible embodiment of a composite space frame structure in the form of an arch bridge 701 incorporating composite structural members in accordance with the present invention. The bridge 701 comprises a pair of arch trusses 703*a,b* from which are suspended a plurality of transverse girders 705 using cables/bars 707. Each arch truss 703*a,b* is formed from a plurality of 3-foot diameter concrete filled fiber-reinforced shells with 12.5-foot spans which are joined together, as shown, and post-tensioned to form a supporting arch on either side of the bridge structure 701. The bridge 701 has an overall span of approximately 200 feet and is supported on either end by a pair of abutments 709*a,b*. The bridge is 64 feet wide with a 40 foot road surface adequate to support four traffic lanes. Pedestrian walkways 719*a,b* are also provided on either side of the road surface 711, separated by the arch tresses 703*a,b*, as shown in FIG. 17C.

Each arch truss 703*a,b* rises above the surface of the road 711 by a distance of about 25 feet at the apex. Two lower main girders 704*a,b* are also connected together, as shown, and post-tensioned to provide a supporting framework for the transverse girders 705. The girders 705 preferably have transverse notches 706 formed at each end thereof for matingly engaging the main girders 704*a,b* in a fashion similar to notched logs in a log cabin. These may be secured together by any of the connection methods described above or by mechanical fasteners or adhesive. The road surface and walkway are formed integrally by a plurality of hollow core topped planks 721, which are laid transversely along the bridge structure to form a road surface 711, as shown. Railings 723*a,b* are provided for added safety.

This invention has been disclosed and described in the context of various preferred embodiments. It will be understood by those skilled in the art that the present invention extends beyond the specific disclosed embodiments to other alternative possible embodiments, as will be readily apparent to those skilled in the art. These may include, without limitation, applications such as lightweight long-span roof structures, industrial support structures, pipe racks in chemical plants, cable stayed bridges and the like. Thus, it is intended that the scope of the present invention herein disclosed should not be limited by the disclosure herein, except as encompassed by a fair reading of the claims which follow.

What is claimed is:

1. A composite structural member comprising a self-supporting, hollow prefabricated outer tubular shell comprising reinforcing fibers in a hardened polymer matrix and an inner concrete core disposed within said outer shell, wherein said shell further comprises a plurality of circumferentially extending ribs formed on an inner surface thereof adapted to engage said concrete core so as to inhibit relative axial displacement thereof.

2. The composite member of claim 1 wherein said reinforcing fibers comprise carbon fibers.

3. The composite member of claim 1 wherein said polymer matrix comprises an epoxy binder cured to a predetermined hardness.

4. The composite member of claim 1 wherein said outer shell is formed from a first group of reinforcing fibers oriented at a first angle relative to a longitudinal axis of said shell and having a combined first predetermined thickness and a second group of fibers oriented at a second angle relative to said longitudinal axis of said shell and having a combined second predetermined thickness.

5. The composite member of claim 4 wherein said first group of reinforcing fibers are oriented between about ±10 degrees and said second group of reinforcing fibers are oriented at about 90 degrees relative to said longitudinal axis.

6. The composite member of claim 5 wherein said first predetermined thickness is between about 0.1 to 0.5 inches.

7. The composite member of claim 5 wherein said second predetermined thickness is between about 0.005 to 0.1 inches.

8. The composite structural member of claim 1 wherein said outer shell comprises filaments of reinforcing fibers which are wound around a rotating mandrel to form said outer shell.

9. The composite member of claim 1 wherein said ribs are formed on at least one end of said shell defining a plastic hinge region for accommodating connection to a footing or other structural member, said ribs being spaced apart and extending inward a distance adequate to prevent pull-out of said concrete core at a predetermined maximum design load.

10. The composite member of claim 1 wherein said ribs are helical and extend along substantially the entire length of said shell.

11. A composite structure member comprising a hollow prefabricated outer tubular shell comprising reinforcing fibers in a hardened polymer matrix and an inner concrete core disposed within said outer shell, further comprising one or more transverse notches formed on said composite member and adapted for mating engagement with one or more corresponding transverse members.

12. A composite structural member comprising:

a self-supporting, hollow outer tubular shell comprising reinforcing fibers in a hardened polymer matrix and an inner concrete core disposed within said outer shell and being formed therein by pouring said concrete in an uncured state into said hollow outer shell and allowing said concrete to harden, wherein said shell further comprises a plurality of ribs formed on an inner surface thereof adapted to engage said concrete core so as to inhibit relative axial displacement thereof.

13. The composite member of claim 12 wherein said reinforcing fibers comprise carbon fibers.

14. The composite member of claim 12 wherein said polymer matrix comprises an epoxy binder cured to a predetermined hardness.

15. The composite member of claim 12 wherein said outer shell is formed from a first group of reinforcing fibers oriented at a first angle relative to a longitudinal axis of said shell and having a combined first predetermined thickness and a second group of fibers oriented a second angle relative to said longitudinal axis of said shell and having a combined second predetermined thickness.

16. The composite member of claim 15 wherein said shell comprises filaments of reinforcing fibers which are wound around a rotating mandrel to form said shell.

17. The composite member of claim 15 wherein said first group of reinforcing fibers are oriented between about ±10 degrees and said second group of reinforcing fibers are oriented at about 90 degrees relative to said longitudinal axis.

18. The composite member of claim 17 wherein said second predetermined thickness is between about 0.005 to 0.1 inches.

19. The composite member of claim 17 wherein said first predetermined thickness is between about 0.1 to 0.5 inches.

20. The composite member of claim 12 wherein said ribs are formed on at least one end of said shell defining a plastic hinge region for accommodating connection to a footing or other structural member, said ribs being spaced apart and extending inward a distance adequate to substantially prevent pull-out of said concrete core at a predetermined maximum design load.

21. The composite member of claim 12 wherein said ribs are helical and extend substantially the entire length of said shell.

22. A fiber-reinforced shell for containing and reinforcing cast concrete, said shell being a prefabricated hollow member and comprising polymer impregnated filaments of reinforcing fibers oriented substantially parallel to the longitudinal axis of said shell and having a combined first predetermined wall thickness, further comprising a plurality of ribs formed on an inner surface of said shell adapted to engage said cast concrete so as to inhibit relative axial displacement thereof.

23. The shell of claim 22 wherein said reinforcing fibers comprise carbon fibers.

24. The shell of claim 22 wherein said reinforcing fibers are impregnated with an epoxy binder.

25. The shell of claim 22 wherein said ribs are formed on at least one end of said shell defining a plastic hinge region for accommodating connection to a footing or other structural member, said ribs extending inward a distance adequate to prevent substantial pull-out of said cast concrete at a predetermined maximum design load.

26. The shell of claim 22 wherein said ribs are formed as a helix.

27. The shell of claim 22 wherein said ribs extend along substantially the entire length of said shell.

28. The shell of claim 22 further comprising polymer impregnated filaments of reinforcing fibers oriented substantially perpendicular to the longitudinal axis of said shell and having a combined second predetermined wall thickness and wherein said first predetermined wall thickness and said second predetermined wall thickness vary along the length of said shell.

29. The shell of claim 22 wherein said shell comprises filaments which are wound around a rotating mandrel to form said shell.

30. A fiber-reinforced shell for containing and reinforcing a core of material, said shell being a prefabricated hollow member comprising reinforcing fibers in a hardened polymer matrix and having a plurality of circumferentially extending ribs formed on an inner surface thereof adapted to engage said core so as to inhibit relative axial displacement thereof.

31. The shell of claim 30, wherein said ribs are formed on at least one end of said shell defining a plastic hinge region for accommodating connection to a footing or other structural member, said ribs being spaced apart and extending inward a distance adequate to prevent pull-out of said core at a predetermined maximum load.

32. The shell of claim 30, wherein said ribs are helical.

33. The shell of claim 30, wherein said ribs extend along substantially the entire length of said shell.

* * * * *

UNITED STATES PATENT AND TRADEMARK OFFICE

CERTIFICATE OF CORRECTION

PATENT NO. : 6,189,286 B1
DATED : February 20, 2001
INVENTOR(S) : Seible et al.

It is certified that error appears in the above-identified patent and that said Letters Patent is hereby corrected as shown below:

Column 21,
Line 19, reads "Truss Bridle" should read -- Truss Bridge --

Signed and Sealed this

Fourth Day of June, 2002

*Attest:*

*Attesting Officer*

JAMES E. ROGAN
*Director of the United States Patent and Trademark Office*